US007773050B2

(12) United States Patent
Nagase et al.

(10) Patent No.: US 7,773,050 B2
(45) Date of Patent: Aug. 10, 2010

(54) SEMICONDUCTOR DEVICE AND PLASMA DISPLAY DEVICE USING THE SAME

(75) Inventors: Takuo Nagase, Hitachi (JP); Mutsuhiro Mori, Mito (JP)

(73) Assignee: Hitachi, Ltd., Tokyo (JP)

( * ) Notice: Subject to any disclaimer, the term of this patent is extended or adjusted under 35 U.S.C. 154(b) by 413 days.

(21) Appl. No.: 11/955,507

(22) Filed: Dec. 13, 2007

(65) Prior Publication Data

US 2008/0143265 A1 Jun. 19, 2008

(30) Foreign Application Priority Data

Dec. 13, 2006 (JP) ..... 2006-335230

(51) Int. Cl.
*G09G 3/28* (2006.01)

(52) U.S. Cl. ..... 345/62; 345/66; 345/55; 345/204; 345/211

(58) Field of Classification Search ..... 345/204, 345/211–214, 66, 62, 61, 76–78; 315/169.1–169.4
See application file for complete search history.

(56) References Cited

U.S. PATENT DOCUMENTS 7,518,574 B2 * 4/2009 Park et al. ..... 345/60

FOREIGN PATENT DOCUMENTS

| | | |
|---|---|---|
| JP | 2000-330514 | 11/2000 |
| JP | 2001-060075 | 3/2001 |
| JP | 2005-309429 | 11/2005 |
| JP | 2005-338784 | 12/2005 |
| JP | 2006-018298 | 1/2006 |
| JP | 2006-072350 | 3/2006 |
| JP | 2006-146217 | 6/2006 |
| JP | 2006-209078 | 8/2006 |
| JP | 2006-222455 | 8/2006 |
| JP | 2006-325084 | 11/2006 |
| JP | 2006-338010 | 12/2006 |
| JP | 2007-017968 | 1/2007 |
| JP | 2007-017979 | 1/2007 |
| JP | 2007-114782 | 5/2007 |

OTHER PUBLICATIONS

K. Ito, et al. "New Two Stage Recovery (TSR) Driving Method for Low Cost AC Plasma Display Panel", IDW (International Display Workshops) 2005.

* cited by examiner

*Primary Examiner*—Tuyet Vo
(74) *Attorney, Agent, or Firm*—Antonelli, Terry, Stout & Kraus, LLP.

(57) ABSTRACT

To provide an AC-PDP capable of achieving low power consumption and low cost, a driving method is adopted in which, during a period of sustaining light emission of the AC-PDP, an electrode of one side of the panel is fixed at a predetermined potential, and positive and negative voltages are alternately applied to an electrode of the other side of the panel. In addition, an IGBT is used as a switch element. Thus, with a half-bridge driving method using an IGBT as a switch element, it is possible to simultaneously achieve a reduction in loss of a driving circuit of the AC-PDP and a reduction in the number of components thereof, such reductions not being able to be achieved by the conventional techniques.

29 Claims, 31 Drawing Sheets

FIG. 20A

| | GATE 1 | GATE 1 |
|---|---|---|
| CONDUCTING STATE | ON | OFF |
| BLOCKING STATE | OFF | ON |

POTENTIAL OF EMITTER 2 IS HIGHER THAN THAT OF EMITTER 1

FIG. 20B

| | GATE 1 | GATE 1 |
|---|---|---|
| CONDUCTING STATE | OFF | ON |
| BLOCKING STATE | ON | OFF |

POTENTIAL OF EMITTER 1 IS HIGHER THAN THAT OF EMITTER2

CHARGE AND DISCHARGE CURRENTS

GAS-DISCHARGE CURRENT WITH LIGHT EMISSION

SEMICONDUCTOR DEVICE AND PLASMA DISPLAY DEVICE USING THE SAME

CROSS-REFERENCE TO RELATED APPLICATION

The present application claims priority from Japanese Patent Application No. JP 2006-335230 filed on Dec. 13, 2006, the content of which is hereby incorporated by reference into this application.

TECHNICAL FIELD OF THE INVENTION

The present invention relates to power saving and cost reduction of plasma display (PDP) devices and, in particular, to a plasma display device suitable for loss reduction of its driving circuit and reduction in the number of components.

BACKGROUND OF THE INVENTION

In recent years, AC-type plasma display devices (AC-PDPs) have been rapidly widespread due to their large screen and slimness compared with conventional cathode-ray-tube televisions and others. However, due to the large screen, its high power consumption and cost becomes problematic.

The display panel of the AC-PDP has X electrodes and Y electrodes alternately arranged approximately in parallel to one another and also has address electrodes crossing in a direction perpendicular to these electrodes to form a two-dimensional matrix.

FIG. 32 is a conceptual drawing of the cell structure of the display panel. A front glass 10*a* and a rear glass 10*f* are separated by ribs, and discharge gas, such as Xe, is enclosed in a discharge space 10 therebetween. A Y electrode 9Y and an X electrode 9X are formed in the front glass 10*a*, and a dielectric layer 10*b* for insulating from the discharge space 10 is formed thereon. Further, an MgO (magnesium oxide) protective layer 10*c* is formed thereon.

On the other hand, an address electrode 9A is formed on the rear glass 10*f*, and a dielectric layer 10*e* for insulating from the discharge space 10 is formed thereon. Further, a phosphorous layer 10*d* is formed thereon.

Drive of the plasma display panel can be divided into a reset period of resetting charges accumulated in the cell, an address period of selecting a light-emission position of the panel, and a sustain period of emitting light from the panel and controlling brightness. In the address period, a voltage is applied between the address electrode 9A and the Y electrode 9Y for discharge so that wall charges are added to the cell, whereby, a cell for light emission in the next sustain period can be selected.

Next, the operation in the sustain period for light emission of the plasma display panel is described. When a voltage is applied to the Y electrode 9Y and the X electrode 9X, a voltage is applied to the discharge space 10. When the voltage becomes equal to or larger than a discharge voltage, light emission occurs. That is, in terms of an electric circuit, a switch 9*c* is turned ON and a discharged state occurs. When this discharge stops, light emission also stops. To repeat light emission, a voltage is required to be applied to the X and Y electrodes of the panel alternately.

FIG. 33 shows changes with time regarding voltages to be applied to the X and Y electrodes of the panel and currents flowing through the panel. The operation for light emission by applying a voltage to a Y side is described below. The same goes for the case where a voltage is applied to an X side for light emission. First, during a period a, an XY wiring capacitance of the panel corresponding to 9*d* of FIG. 32 is charged to increase a voltage to be applied to the cell. At this time, a charge current flows through the panel. When the voltage to be applied to the cell becomes higher than a firing voltage, the cell emits light, and a gas-discharge current with light emission flows during a period b. At this time, due to an inductance of the wiring, a resistance of a switch element, and other factors, the panel voltage is decreased by ΔV. Next, the panel voltage is decreased in a period c. At this time, a discharge current flows through the panel. This operation of applying a voltage alternately to the X and Y electrodes of the panel for light emission is repeated at a high speed of several ten to several hundred kHz.

FIGS. 34A and 34B show main driving circuits and their operations for achieving the above-described operation. First, a bi-directional switch element 402*y* is turned ON to charge the XY wiring capacitance of the panel via a coil 5*y*. This corresponds to the period a in FIG. 33, and a current flows through a path indicated by the charge current shown in FIG. 34A. After the voltage of a Y-side electrode 6*y* of the panel is increased to a predetermined voltage, when a switch element 1*y* (hereinafter referred to as a clamp element) is turned ON to clamp the panel voltage at a power-supply voltage Vs, the voltage applied to the cell becomes equal to or larger than the discharge voltage, thereby emitting light. This corresponds to the period b in FIG. 33, and a current flows through a path indicated by the gas-discharge current causing light emission in FIG. 34B. Next, the bi-directional switch element 402*y* is turned ON to discharge the XY wiring capacitance of the panel via the coil 5*y*. This corresponds to the period c in FIG. 33, and a current flows through a path indicated by the discharge current in FIG. 34A.

Charging and discharging of the XY wiring capacitance of the panel is performed via the coil because the panel voltage is increased and decreased by using a resonant operation of the XY wiring capacitance and the coil of the panel, thereby reducing a loss in the XY wiring capacitance of the panel at the time of charging and discharging.

In the above-described operation, due to the charge current, the gas-discharge current causing light emission, and the discharge current passing through the switch elements, a loss occurs in each switch element. Such a loss is a cause of increasing power consumption of the plasma display device. Moreover, since a driving circuit is required on both X and Y sides of the panel, the number of components is increased. Such an increase is a cause of increasing cost.

To solve the problems in achieving a low loss of the driving circuit and a reduction in the number of components, driving circuits shown in FIGS. 35 and 37 have been suggested.

FIG. 35 shows a driving circuit of a plasma display device disclosed in Japanese Patent Application Laid-Open Publication No. 2000-330514 (Patent document 1). The driving circuit has a feature in which as a switch element, an Insulated Gate Bipolar Transistor (IGBT) is used in place of a conventional power MOSFET. Unlike the power MOSFET, in the IGBT, conductivity modulation occurs in the element. Therefore, the resistance is small, thereby reducing a loss in the driving circuit.

Here, in FIG. 35, only one driving circuit of the panel is shown, and the other one is fixed to the ground, but the driving circuit side fixed to the ground is considered to be omitted. The reason is that the amplitude of the shown driving circuit is based on a power-supply voltage from the ground, and therefore the voltage applied between X and Y of the panel cannot be changed to be positive or negative. Thus, as the AC-PCP, light emission cannot be repeated. For this reason, the driving circuits suggested in Japanese Patent Application Laid-Open Publication No. 2000-330514 are considered to be as shown in FIG. 36.

However, unlike the power MOSFET, a general IGBT does not incorporate a diode. Therefore, as shown in FIG. 36, when a discharge current flows at one driving circuit, a diode has to be added in inverse-parallel in order to pass a current from an emitter to a collector of an IGBT of the other circuit. For this reason, there are problems of increasing a number of components, complexing circuitry and assembling process, and becoming high cost.

FIG. 37 shows a driving method published in "New Two Stage Recovery (TSR) Driving Method for Low Cost AC Plasma Display Panel", IDW (International Display Workshops) '05. In this driving method, either one of an X side or a Y side of the panel is fixed to the ground, and positive and negative voltages are alternately applied to the other side, thereby sustaining light emission. This driving method is hereinafter referred to as a half-bridge driving method. By contrast, a method used in the circuitry in FIGS. 34A and 34B is referred to as a full-bridge driving method.

In the half-bridge driving method, unlike the full-bridge driving method, a driving circuit on one side can be omitted, therefore, significantly reducing the number of component is achieved. Furthermore, in FIGS. 34A and 34B, at the time of passing a gas-discharge current with light emission, a charge current, and a discharge current, a voltage drop occurs at switch elements at both of the X and Y sides in the full-bridge driving method. By contrast, advantageously, in the half-bridge driving method, a voltage drop occurs only at the switch element on one side. However, in the half-bridge driving method of FIG. 37, a power MOSFET is used as a switch element, and the present inventors have found through studies that there are problems as described below.

FIG. 38 shows panel driving waveforms in the half-bridge driving method disclosed in the above-described publication. In an AC-PDP, as described above, positive and negative voltages are alternately applied between X and Y of the panel, thereby repeating light emission. Therefore, in the half-bridge driving method in which one side of the panel is fixed to the ground, positive and negative voltages ±Vs are required to be applied to the other side of the panel to drive the panel. In the full-bridge driving method, voltages to be output from the driving circuit are from 0V to Vs, the breakdown voltage of the switch element in the half-bridge driving method is disadvantageously doubled compared with the full-bridge driving method.

Vs of the AC-PDP is on the order of 200V. In the full-bridge driving method, as a switch element, a power MOSFET with a breakdown voltage on the order of 300V is used. Therefore, the power MOSFET for use in the half-bridge driving method is required to have a breakdown voltage on the order of 600V.

Output characteristics of these power MOSFET are shown in FIG. 39. From these results, it can be found that a resistance of one 600V power MOSFET is larger than a resistance of two 300V power MOSFET in series with a full-bridge driving method. This is because the resistance of the power MOSFET is increased in proportion to 2.5-th power of the breakdown voltage.

For this reason, in the half-bridge driving method using the power MOSFET of FIG. 37, there has been a problem that a loss of the driving circuit is disadvantageously increased compared with the full-bridge driving method using the power MOSFET.

SUMMARY OF THE INVENTION

An object of the present invention is to achieve a reduction in loss of the driving circuit of a plasma display device and a reduction in the number of components thereof, such reductions not being able to be achieved by the full-bridge driving method using a power MOSFET, the half-bridge driving method using an IGBT, and the half-bridge driving method using a power MOSFET that are conventionally disclosed.

To achieve the problem described above, a plasma display device according to the present invention comprises:

a plurality of first electrodes;

a plurality of second electrodes disposed in approximately parallel with the plurality of first electrodes, the second electrodes forming display cells with the first electrodes adjacent to the second electrodes and discharge being executed between the first electrodes and the second electrodes forming the display cells; and a plurality of third electrodes formed in a crossing direction with respect to the first electrodes and the second electrodes, wherein during a period in which light emission of the plasma display panel is sustained, a potential of the first electrodes is maintained at a first constant potential, and a first positive voltage for the first electrodes and a second negative voltage for the first electrodes are alternately applied to the second electrodes, and a first driving circuit board for applying a voltage to the second electrodes comprises:

a first switch element clamped at a high level for carrying a gas-discharge current with light emission;

a second switch element clamped at a low level for carrying a gas-discharge current with light emission;

a third switch element for charging and discharging capacitance of the plasma display panel via a coil; and the first, the second, and the third switch elements being IGBTs.

Also, to achieve the problem described above, a semiconductor device for driving a plasma display panel according to the present invention comprises:

a plurality of first electrodes;

a plurality of second electrodes disposed in approximately parallel with the plurality of first electrodes, the second electrodes forming display cells with the first electrodes adjacent to the second electrodes and discharge being executed between the first electrodes and the second electrodes forming the display cells; and a plurality of third electrodes formed in a crossing direction with respect to the first electrodes and the second electrodes, wherein during a period in which light emission of the plasma display panel is sustained, a potential of the first electrodes is maintained at a first constant potential, and a first positive voltage for the first electrodes and a second negative voltage for the first electrodes are alternately applied to the second electrodes, and a first driving circuit board for applying a voltage to the second electrodes comprises:

a first switch element clamped at a high level for carrying a gas-discharge current with light emission;

a second switch element clamped at a low level for carrying a gas-discharge current with light emission;

a third switch element for charging and discharging capacitance of the plasma display panel via a coil; and the first, the second, and the third switch elements serving as IGBTs.

With the half-bridge driving method using an IGBT as a switch element, it is possible to simultaneously achieve a reduction in loss of the driving circuit of a AC-PDP and a reduction in the number of components thereof, such reductions not being able to be achieved by the conventional techniques.

Furthermore, by using a reverse-conductive IGBT, a reverse-blocking IGBT, and a bi-directional IGBT are used as switch elements, the number of components can be reduced, and therefore assembling processing can be simplified, compared with the case of using a conventional IGBT and a diode separately. Furthermore, by incorporating a diode, a loss can be reduced. Still further, as a result of not requiring electric power distribution dedicated to diodes, wiring can be shortened, noise occurring at an inductance of the wiring can be decreased, thereby achieving an easy-to-handle driving circuit.

BRIEF DESCRIPTIONS OF THE DRAWINGS

FIG. 20A is a drawing showing a method of driving gates according to the present invention by the bi-directional IGBT used as a bi-directional switch element for the plasma display device according to the present invention;

FIG. 20B is a drawing showing a method of driving gates according to the present invention by the bi-directional IGBT used as a bi-directional switch element for the plasma display device according to the present invention;

DESCRIPTIONS OF THE PREFERRED EMBODIMENTS

Embodiments of the present invention are described in detail below with reference to the drawings.

Figure 1:
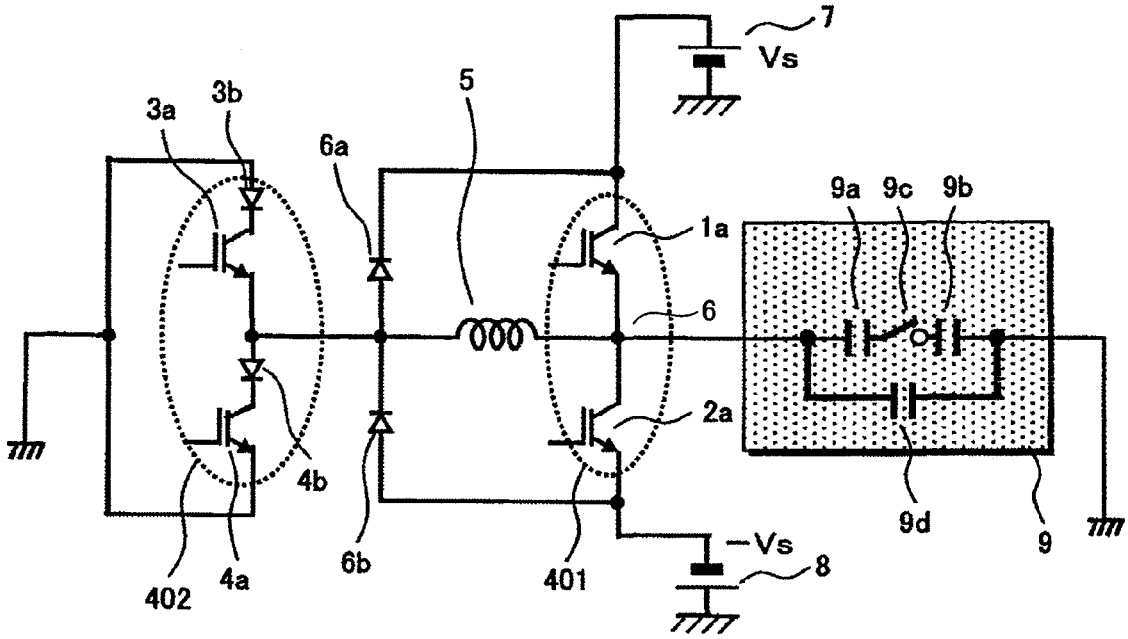
FIG. 1 is a drawing of an embodiment of a plasma display device according to the present invention.

FIG. 1 shows an example of an AC-PDP driving circuit according to the present invention is applied. One side of a panel is fixed to the ground. On the other side of the panel, a driving circuit is disposed, and IGBTs are used for a bi-directional switch element 402 that charges and discharges the capacitance of the panel via a coil 5 and a clamp element 401 that clamps the voltage of the panel to a power-supply voltage to carry a gas-discharge current with light emission.

Figure 2:
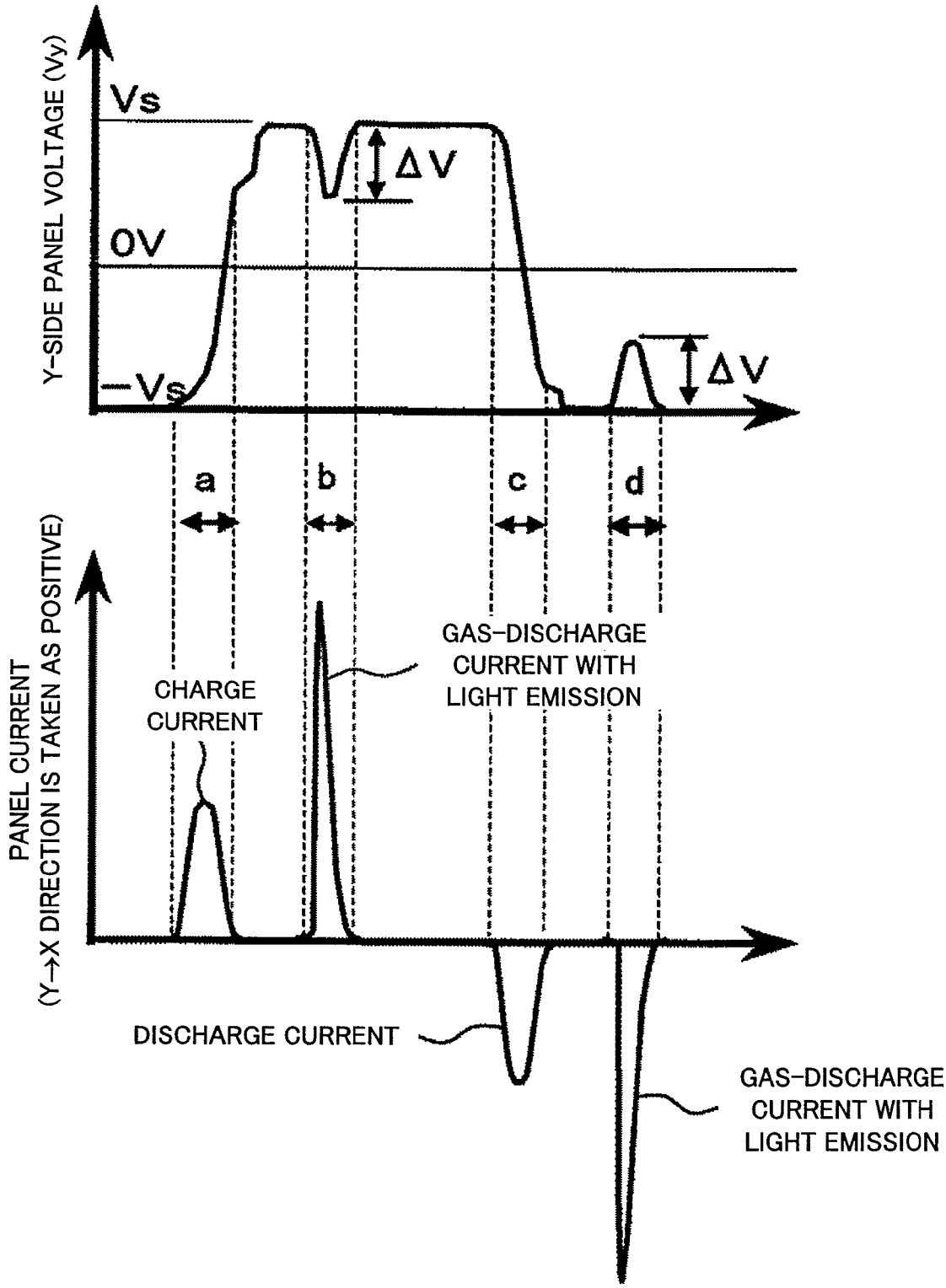
FIG. 2 is a drawing of an embodiment of a driving waveform of the plasma display device according to the present invention.

FIG. 2 shows an example of panel driving waveforms of the AC-PDP according to the present invention. The potential of an X-side electrode of the panel is fixed to the ground, and positive and negative voltages are alternately applied to a Y-side electrode, thereby sustaining light emission.

With such a structure, in the present invention, a reduction in loss of the driving circuit and a reduction in the number of components thereof are simultaneously achieved, such reductions not being able to be achieved by the conventional driving circuit of a PDP.

Figure 3:
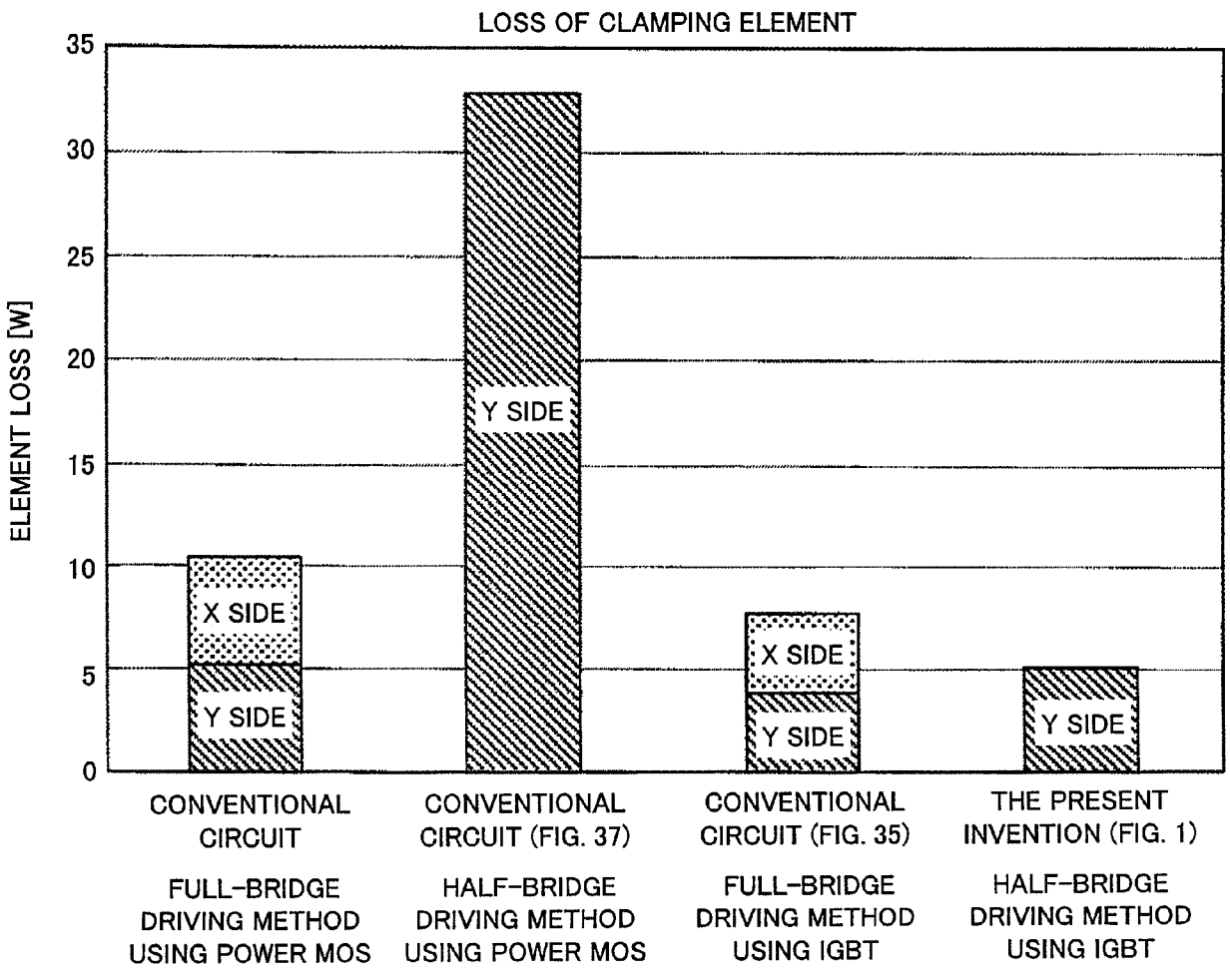
FIG. 3 is a graph of comparison of loss of clamping elements between plasma display devices in the present invention and conventional techniques.
Figure 4:
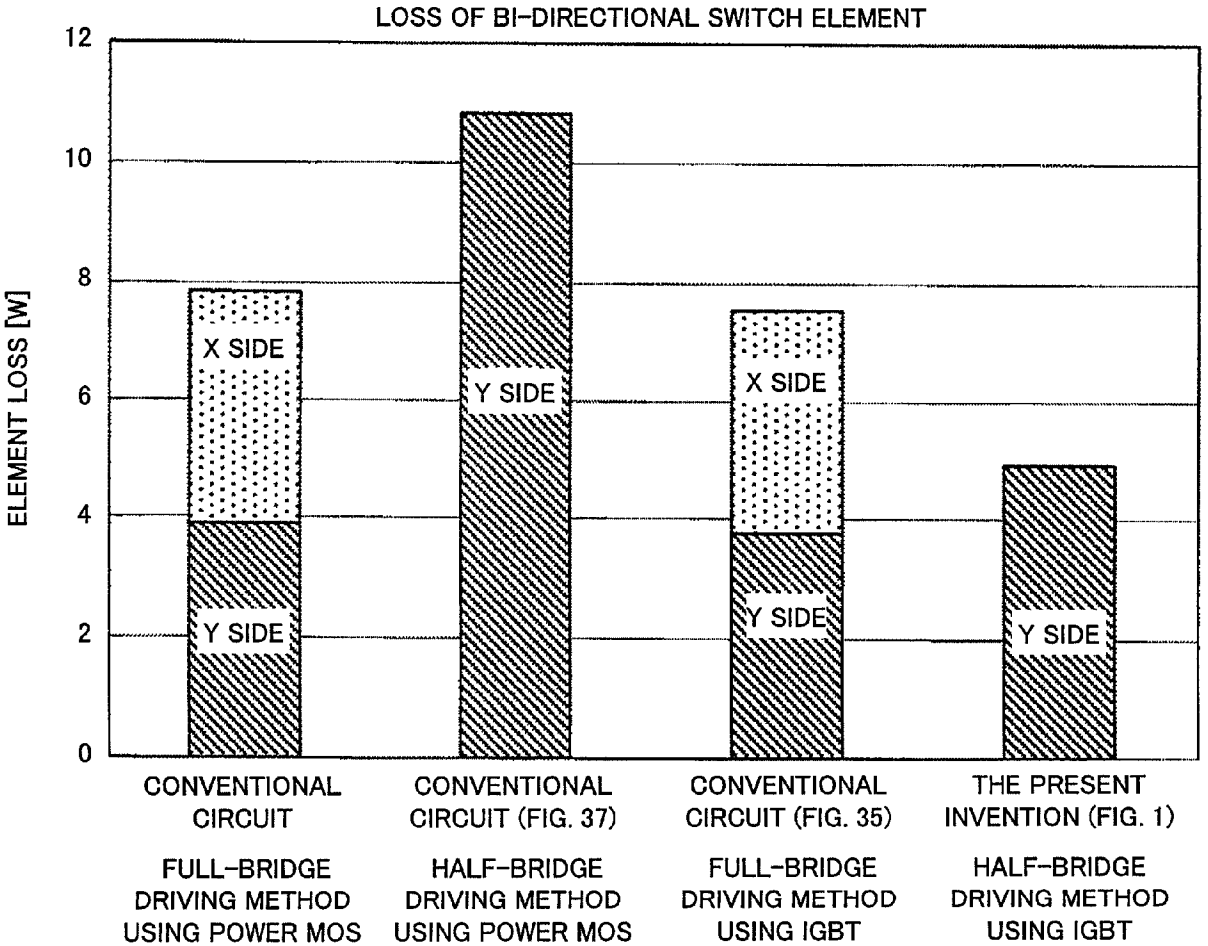
FIG. 4 is a graph of comparison of loss of bi-directional switch elements between plasma display devices in the present invention and the conventional techniques.
Figure 37:
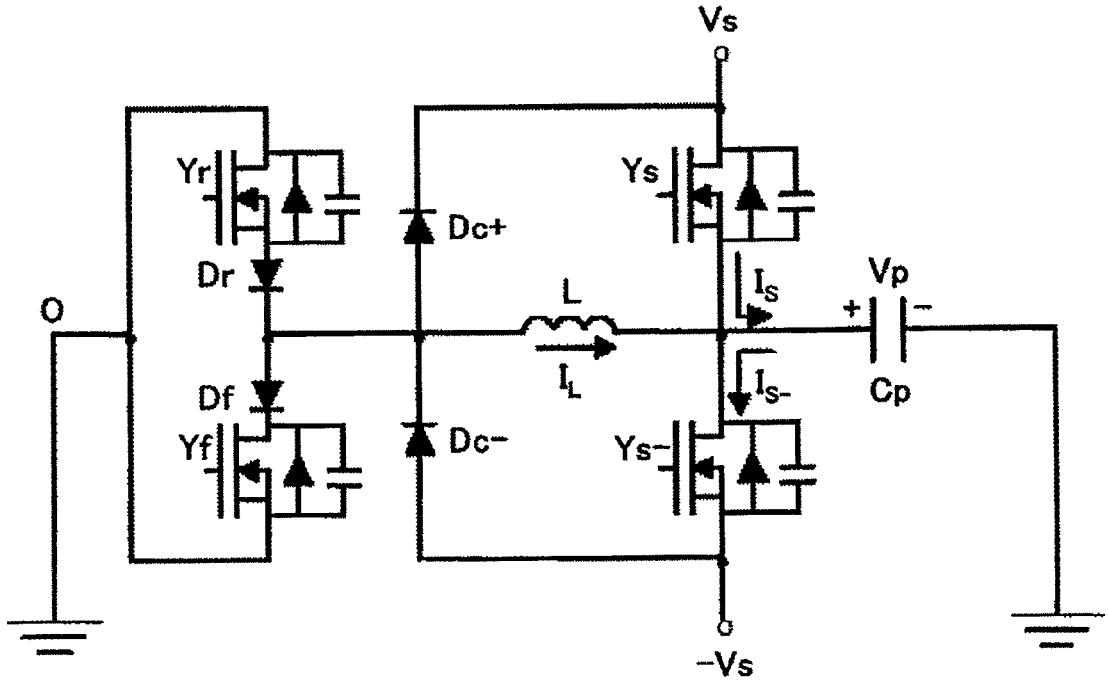
FIG. 37 shows circuits of a conventional half-bridge driving method in which a power MOSFET is used as a switch element.
Figure 38:
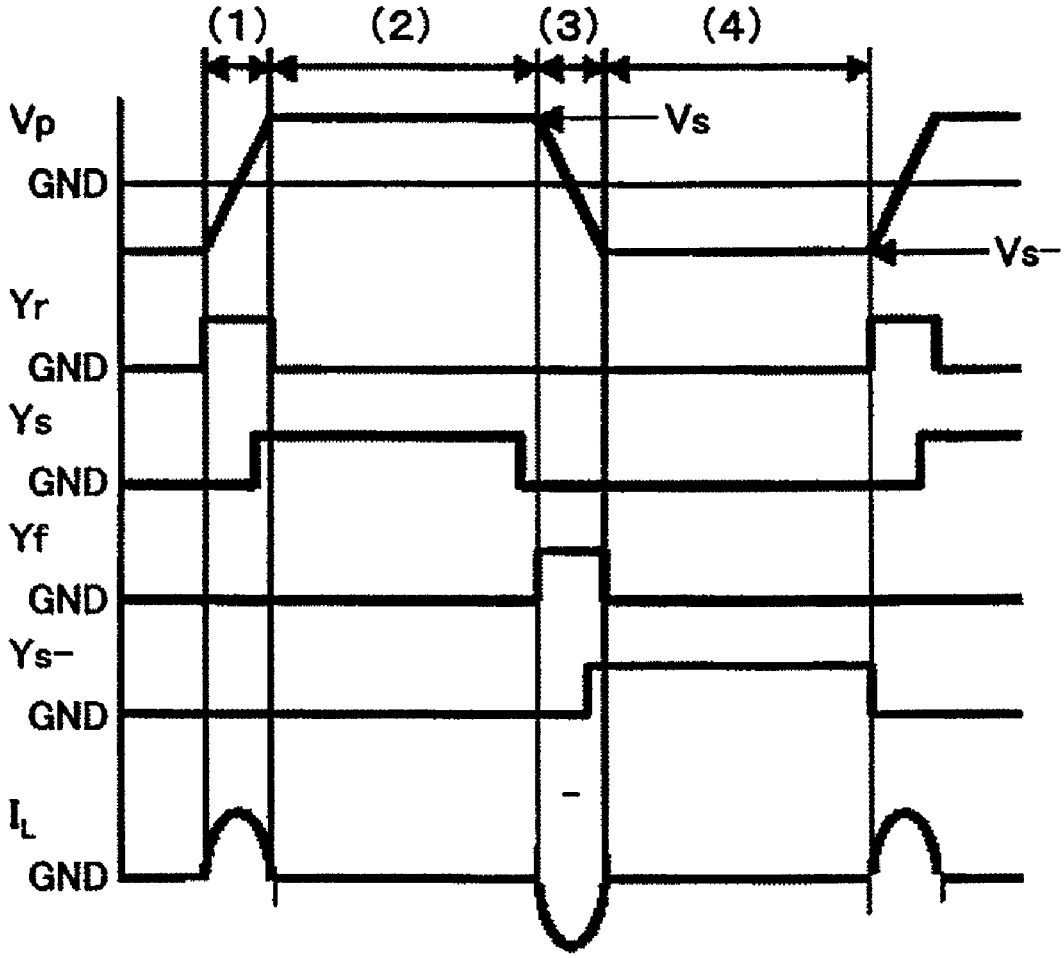
FIG. 38 shows driving waveforms of the conventional driving method in FIG. 37.

FIGS. 3 and 4 each show comparison in loss of a bi-directional switch element and a clamp element among:

(1) the full-bridge driving method using a power MOSFET; (hereinafter referred to as power-MOSFET-based full-bridge driving method 1);

(2) the half-bridge driving method using a power MOSFET (FIG. 37) (hereinafter referred to as power-MOSFET-based half-bridge driving method 2);

(3) the full-bridge driving method using an IGBT (FIG. 35) (hereinafter referred to as IGBT-based full-bridge driving method 3), the methods 1 to 3 having been described as conventional technologies, and;

(4) the half-bridge driving method using an IGBT (FIG. 1) (hereinafter referred to as IGBT-based half-bridge driving method 4) according to the present invention. It can be found that the losses of the clamp element and the bi-directional switch element, in the driving method according to the present invention, are the smallest, respectively.

Figure 39:
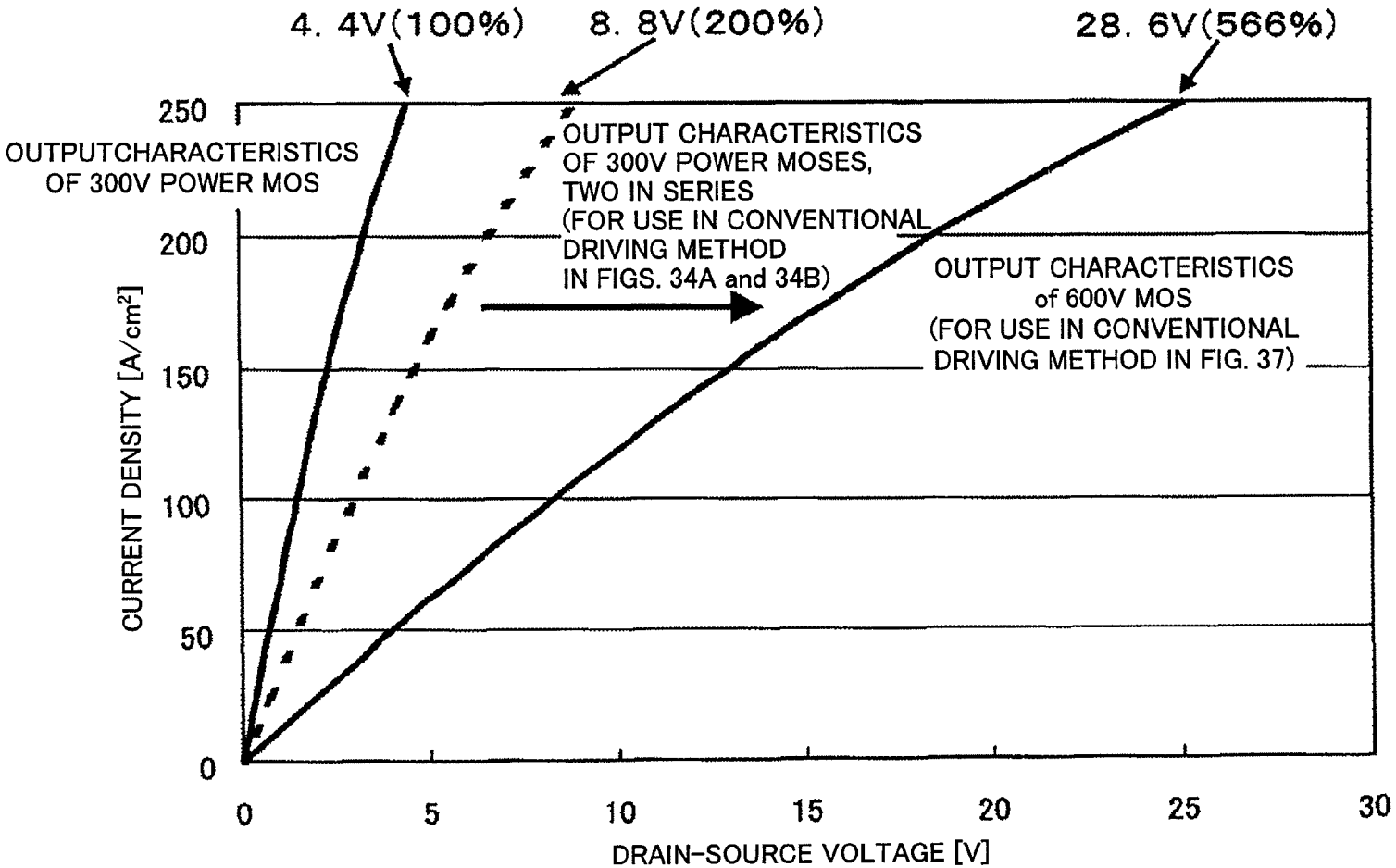
FIG. 39 shows each of output characteristics of a switch element, in the conventional full-bridge driving method in which a power MOSFET is used as a switch element and in the conventional half-bridge driving method in which a power MOSFET is used as a switch element.

The loss of the power-MOSFET-based half-bridge driving method 2 (FIG. 37) is larger than that of the power-MOSFET-based full-bridge driving method 1 because, as described with reference to FIG. 39, when the breakdown voltage is doubled with a half-bridge driving method, the resistance of one power-MOSFET element is larger than the resistance of two power-MOSFETs in series with a full-bridge driving method. The loss of the IGBT-based full-bridge driving method 3 (FIG. 35) is smaller than the loss of the power-MOSFET-based full-bridge driving method 1 because, unlike the power MOSFET, in the IGBT, conductivity modulation occurs in the element and the resistance becomes smaller than that of the power MOSFET.

Figure 5:
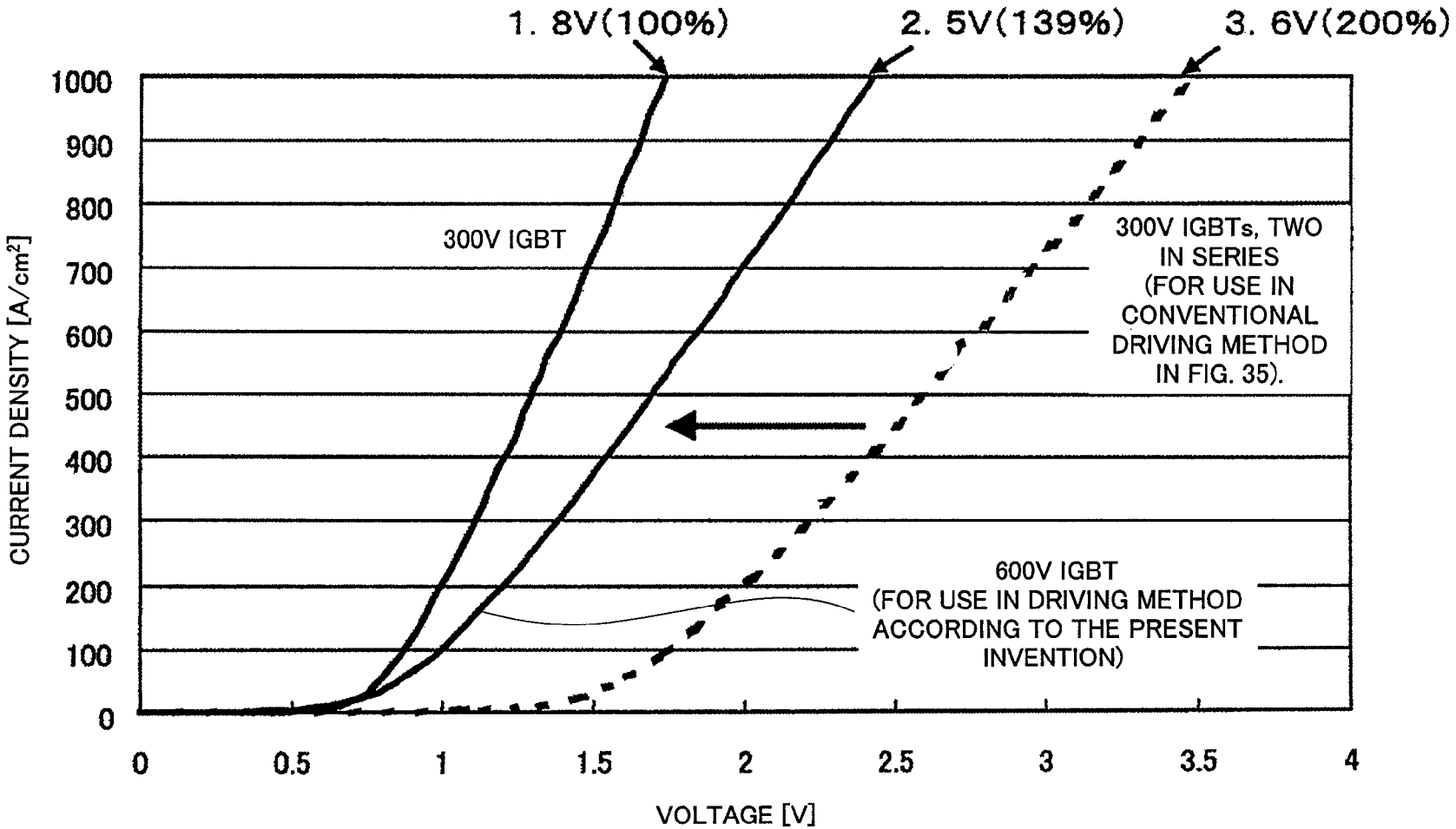
FIG. 5 is a graph of comparison of output characteristics of semiconductor devices used in the plasma display device in the present invention and the conventional technique.
Figure 35:
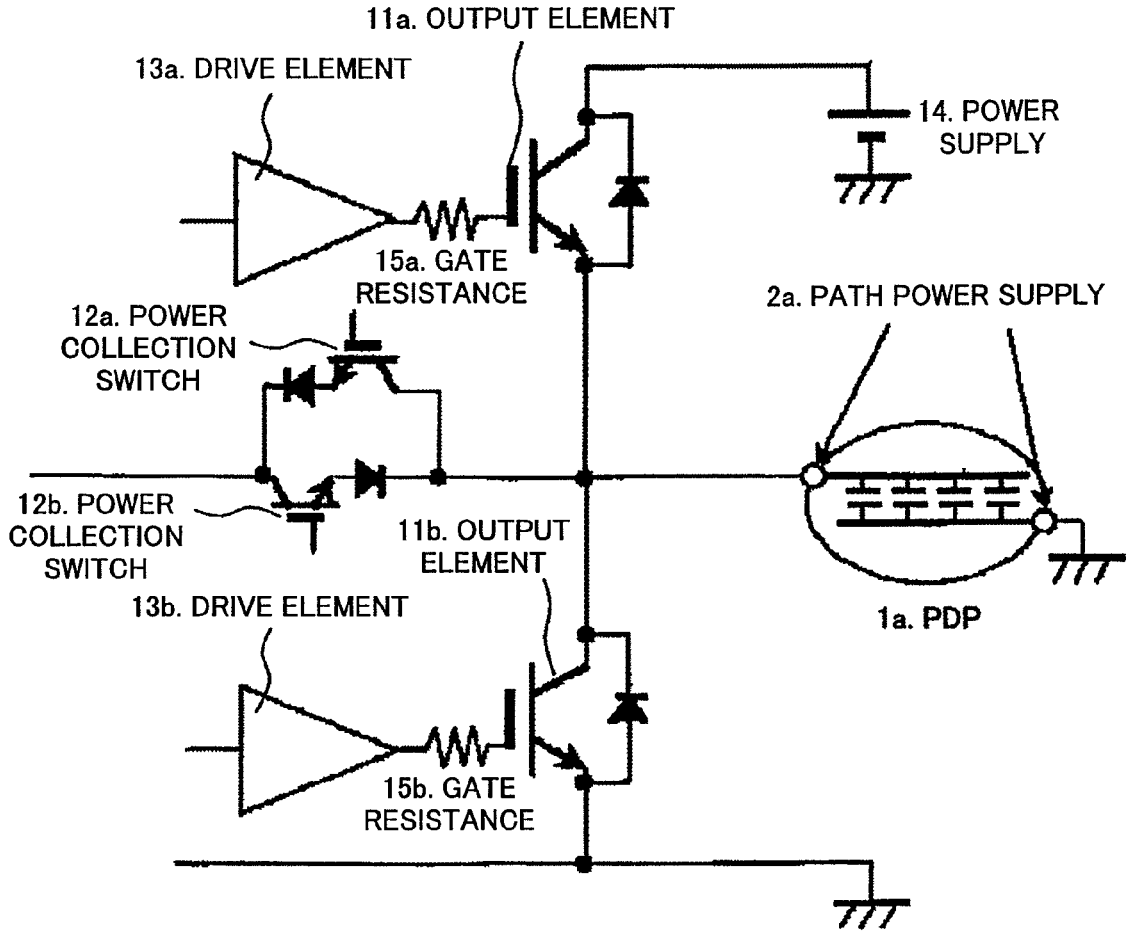
FIG. 35 shows a conventional full-bridge driving method in which an IGBT is used as a switch element.
Figure 36:
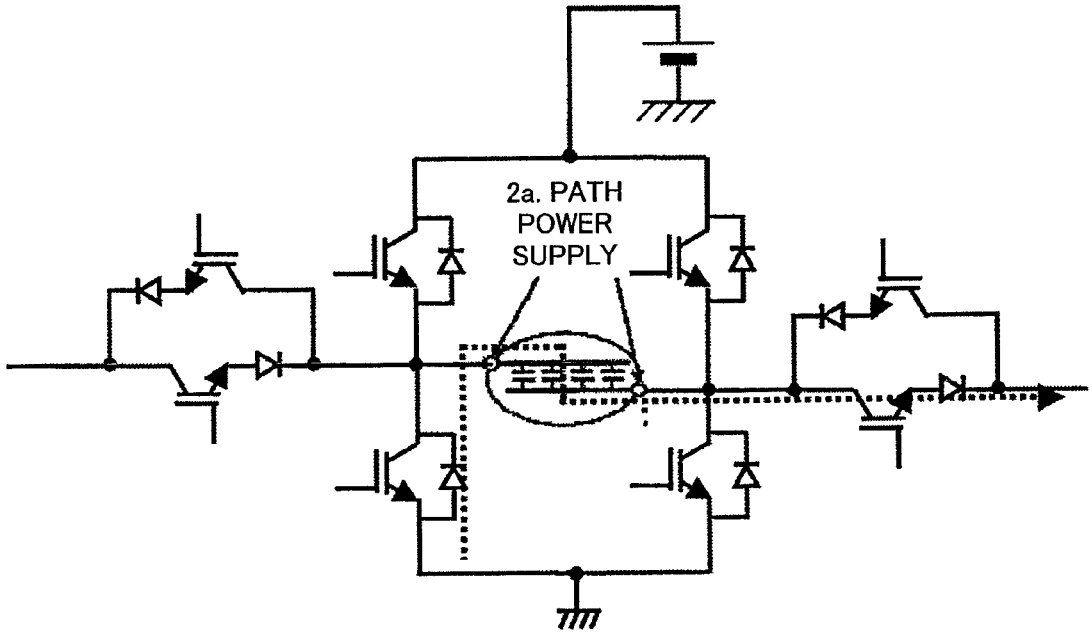
FIG. 36 shows circuits including omitted one side circuit in FIG. 35.

The loss of the IGBT-based half-bridge driving method 4 (FIG. 1) according to the present invention is smaller than the loss of the IGBT-based full-bridge driving method 3 (FIG. 35) because, as can be seen from the output characteristics shown in FIG. 5, the resistance of one 600V-IGBT in the IGBT-based half-bridge driving method 4 (FIG. 1) is lower than the resistance of two 300V-IGBTs in series in the IGBT-based full-bridge driving method 3 (FIG. 35). The reason why the resistance of the IGBT tends not to depend on the breakdown voltage compared with the power MOSFET is as follows.

In the resistances of the IGBT and the power MOSFET, the resistance of a high-resistance $n^-$-layer ensuring the breakdown voltage is dominant. Here, unlike the power MOSFET, in the IGBT, conductivity modulation occurs in the element at the time of conduction. Therefore, the resistance of the $n^-$-layer does not depend on the resistivity of the $n^-$-layer that increases with the breakdown voltage.

The present inventors have found that the above-described characteristics and the fact the IGBT-based half-bridge driving method according to the present invention can achieve the smallest loss of the driving circuit and also can reduce the number of components.

The potential-fixed side is most desirably connected to a chassis at the ground potential. However, in principle, that side can be fixed to the potential other than the ground during a period of sustaining light emission. In one exemplary method, the electrode of the panel is connected to a power supply that provides the potential or a capacitor that divides the power-supply voltage.

Also, in the half-bridge driving method according to the present invention, it is required that the lifetime of the IGBT being controlled. The plasma display panel performs switching at high speeds of several tens kHz to several hundreds kHz. Therefore, after charging, discharging, and carrying a gas-discharge current with light emission, excess carriers inside the switch element accumulated during an ON state have to be immediately extinguished. In the half-bridge driving method according to the present invention, since the breakdown voltage of the IGBT is doubled, the thickness of the element is increased in order to ensure the breakdown voltage, and the excess carriers internally accumulated are also increased. For this reason, the lifetime of the IGBT has to be equal to or smaller than 1 μs at maximum.

If the lifetime of the clamp element is long and excess carriers are left, when the other one of the paired clamp elements is turned ON, the current from a power supply 7 penetrates through both of the clamp elements to flow, thereby causing an extremely large loss. The same goes for the bi-directional switch. That is, after carrying a current for charging and discharging the panel capacitance, when any one of the clamp elements is turned ON and a voltage is applied to both ends of the element, if the lifetime is long and excess carriers are left, a large current disadvantageously flows and causes a loss.

Figure 6:
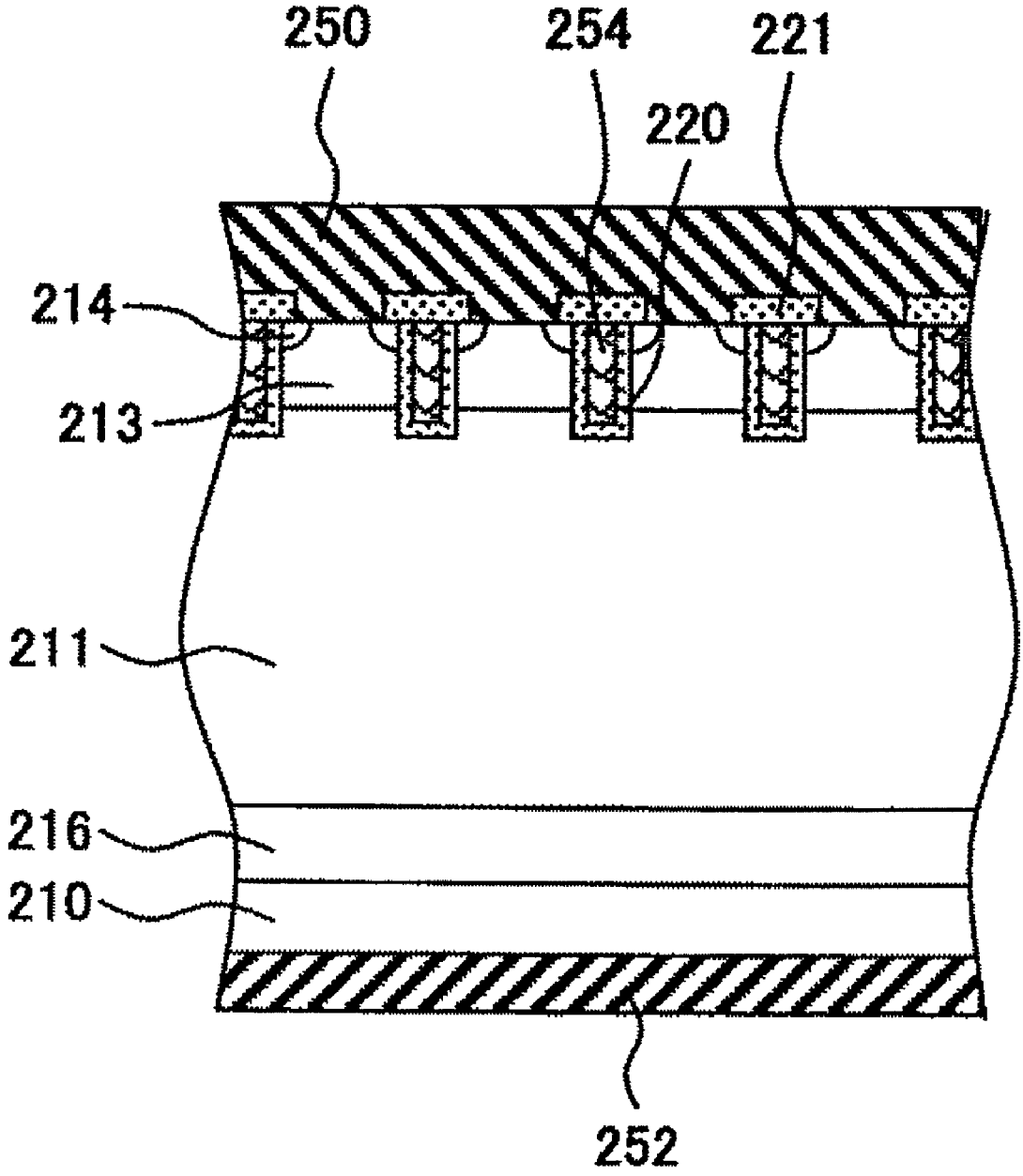
FIG. 6 shows an embodiment of an IGBT having trench gates, which is used as a clamping element for the plasma display device according to the present invention.

FIG. 6 shows an IGBT having a trench gate structure as a preferred embodiment of the IGBT.

As well known, in structures of an IGBT, in addition to the trench structure described in the embodiment, there is a planar-gate structure in which a planar insulating gate is formed on the silicon surface. As a result of studies, it has been found that the IGBT with a trench-gate structure has a lower loss. The reason is that, since the plasma display device carries an abrupt current through a capacitance load, an IGBT with a larger saturation current density, that is, an IGBT with a high-density insulating gate per unit area, is preferable.

Figure 7:
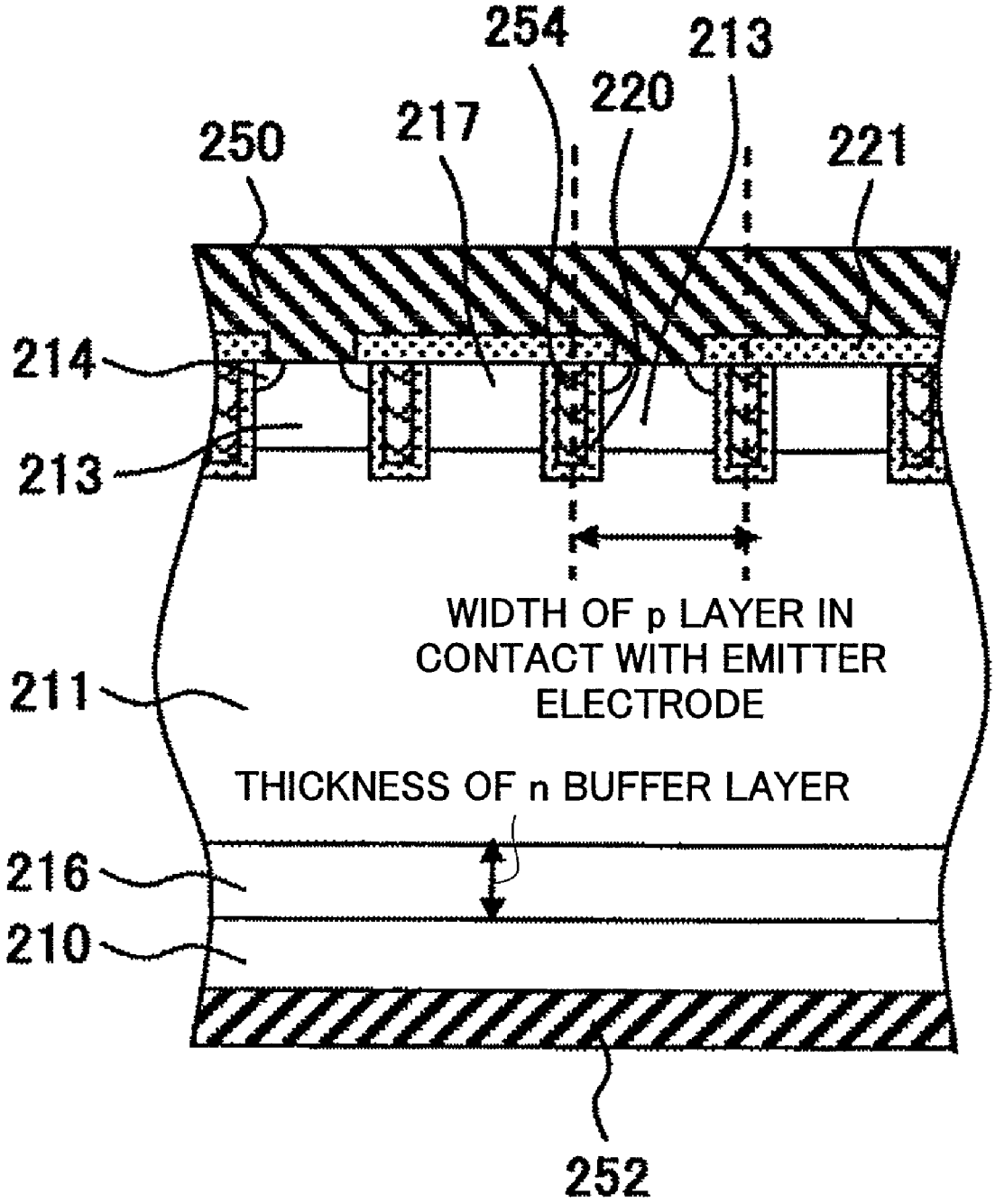
FIG. 7 shows another embodiment of an IGBT having trench gates, which is used as a clamping element for the plasma display device according to the present invention.

FIG. 7 shows a further preferable embodiment of the IGBT, which has a feature in which a floating p-layer 217 is provided to alternate spaces between trench gates. By providing this floating p-layer 217, conductivity modulation of the IGBT having a trench-gate structure can be further promoted, which has been found by the present inventors in Japanese Patent Application Laid-Open Publication No. 11-38166, which discloses another invention. This structure described in the application is also effective for the plasma display device with capacitance load.

As a result of further studies, in order to decrease an ON-state voltage (a voltage drop at the time of conduction) of the IGBT, it is effective to narrow the width of a p-layer 213 in contact with an emitter electrode 250 in a state of low resistance to promote conductivity modulation.

Figure 8:
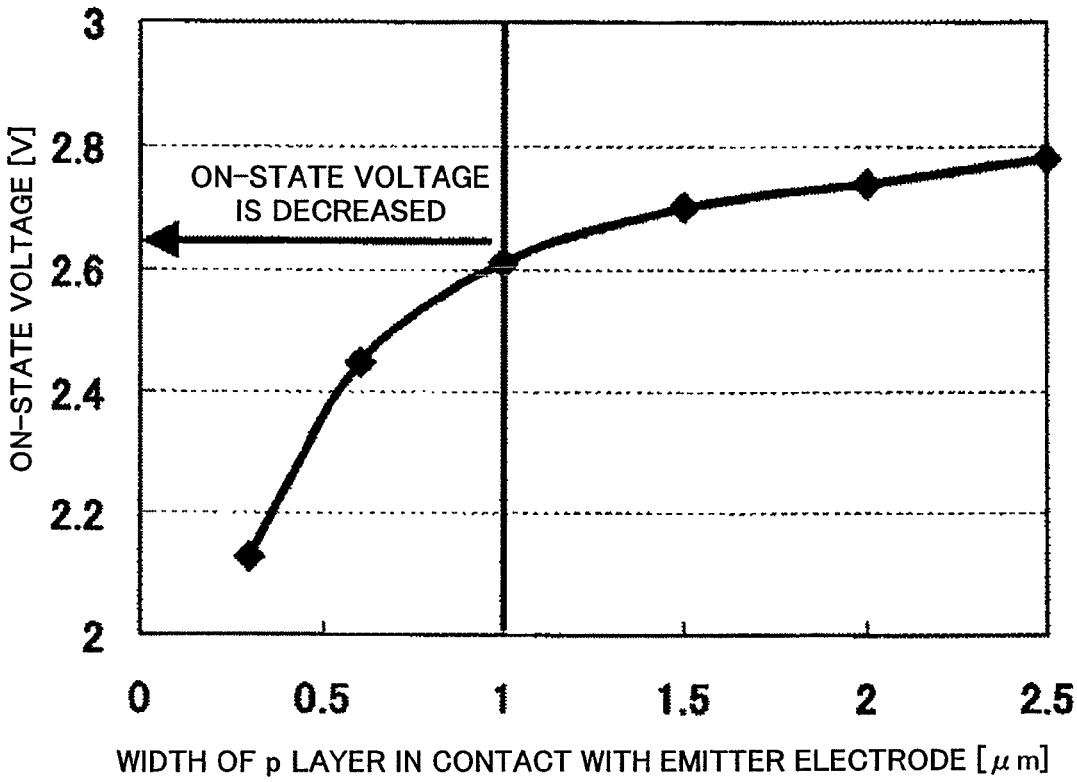
FIG. 8 is a graph showing a result of calculation of dependence on the width of a p-layer contacting with an emitter electrode with respect to an ON-state voltage of the IGBT in the embodiment of FIG. 7.

FIG. 8 shows a relation between the width of the p-layer 213 and the ON-state voltage. From the results, it can be found that the effect is large if the width of the p-layer 213 is equal to or smaller than 1.0 μm. The narrowing limitation of the width of the p-layer 213 is on the order of 0.1 μm. If the width is narrower than that, stability in process cannot be ensured.

Therefore, the width of p-layer 213 is desirably equal to or smaller than 1.0 μm.

In the IGBT-based half-bridge driving method according to the present invention, it has been found that the loss is also required to be decreased when the IGBT used as a switch element is turned ON. In the half-bridge driving method according to the present invention, when the breakdown voltage of the IGBT is doubled with respect to the conventional full-bridge driving method, the thickness of the $n^-$-layer with a high resistance is increased in order to ensure the breakdown voltage. The present inventors have found that, the time duration from the gate of the IGBT being turned ON, and excess carriers being accumulated in an $n^-$-layer 211 until conductivity modulation being completed is increased, therefore, a turn-on loss is increased to a non-negligible degree. In the course of turn-on, holes are injected from a $p^+$-layer 210 to an $n^-$-layer 211. In order to ensure the breakdown voltage, since an n-type buffer layer 216 interposed between the $p^+$-layer 210 and the $n^-$-layer 211 has a high concentration, the lifetime of holes is short and it takes some time for holes to reach the $n^-$-layer 211. For this reason, the n-type buffer layer 216 is desirably as thin as possible.

Figure 9:
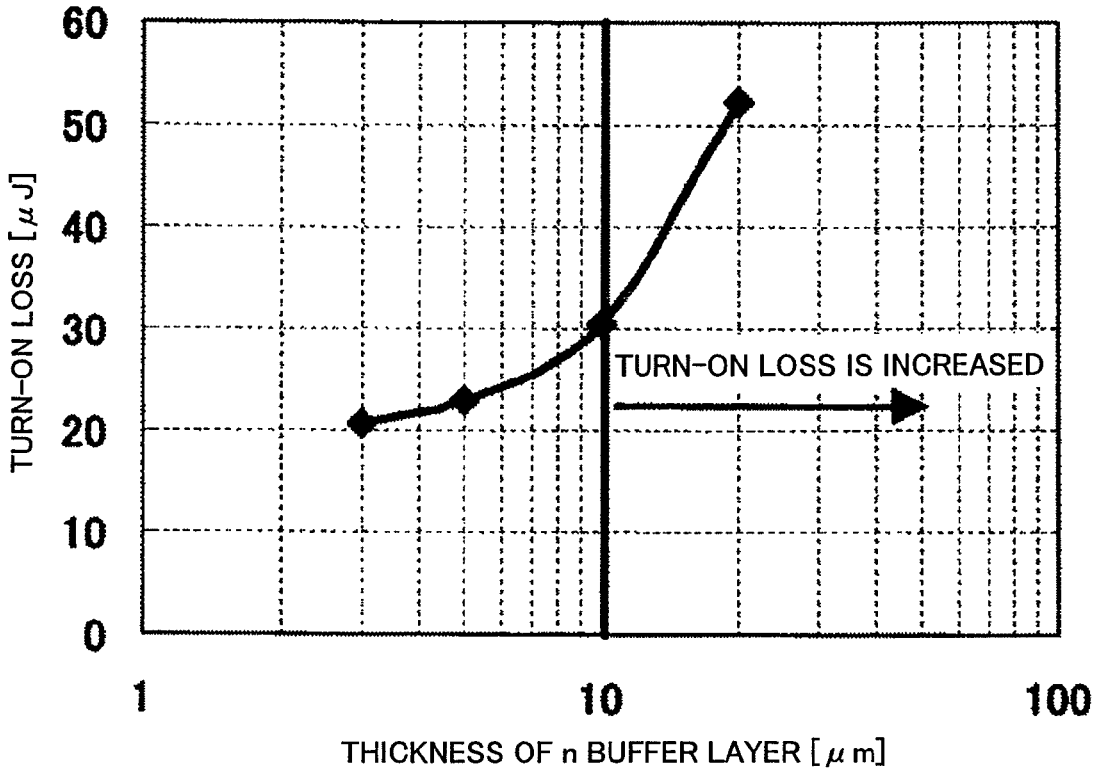
FIG. 9 is a graph showing a result of calculation of dependence on the thickness of the n-type buffer layer with respect to a turn-on loss, in the IGBT used as a clamping element of the plasma display device according to the present invention.

FIG. 9 shows a relation between the thickness of the n-type buffer layer 216 and a turn-on loss. From the results, when the n-type buffer layer 216 has a thickness equal to or larger than 10 μm, the turn-on loss is rapidly increased. Therefore, the thickness of the n-type buffer layer 216 is desirably equal to or smaller than 10 μm.

Next, a preferable embodiment of the clamp element is described.

Figure 10:
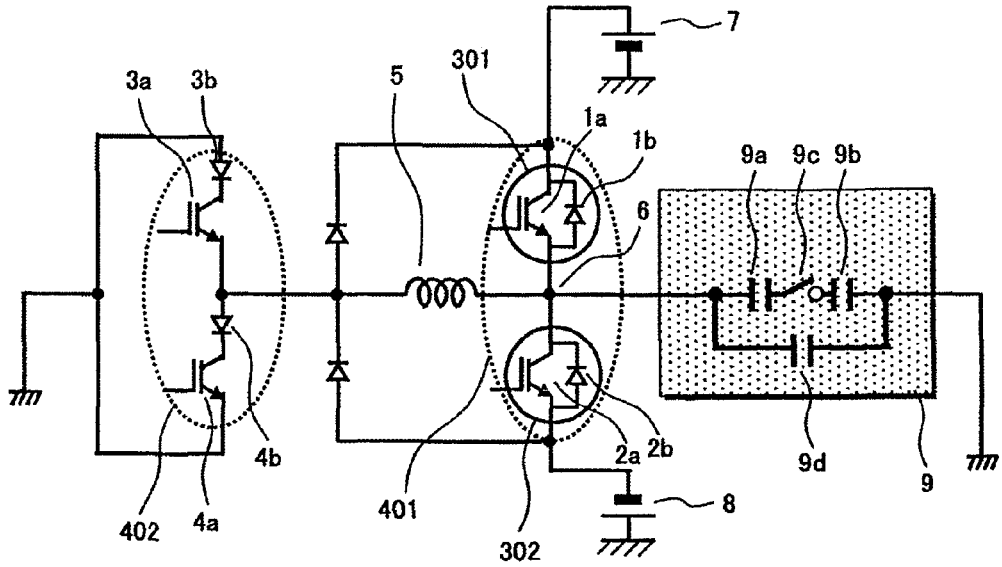
FIG. 10 is a drawing of an embodiment of the plasma display device according to the present invention in which an IGBT having a reverse-conductive diode incorporated therein is used as a clamping element.

FIG. 10 shows a driving circuit using structures 301 and 302 in which a diode for reverse conducting is integrated in an IGBT (hereinafter referred to as a reverse-conductive IGBT) as a clump element. When the inductance of wiring and a panel capacitance 9*d* resonate, a diode 1*b* of the reverse-conductive IGBT clamps a resonance midpoint 6 so that it does not have a voltage equal to or higher than the voltage of a power supply 7, thereby effectively suppressing noise due to a surge voltage. It has been found that the current flowing through this diode 1*b* is as small as 1/10 or smaller with respect to a current flowing through an IGBT 1*a*, and a diode with a small current capacitance is enough, therefore, the diode 1*b* can be integrated around the outer perimeter of a chip of an IGBT 1*a*.

Figure 11:
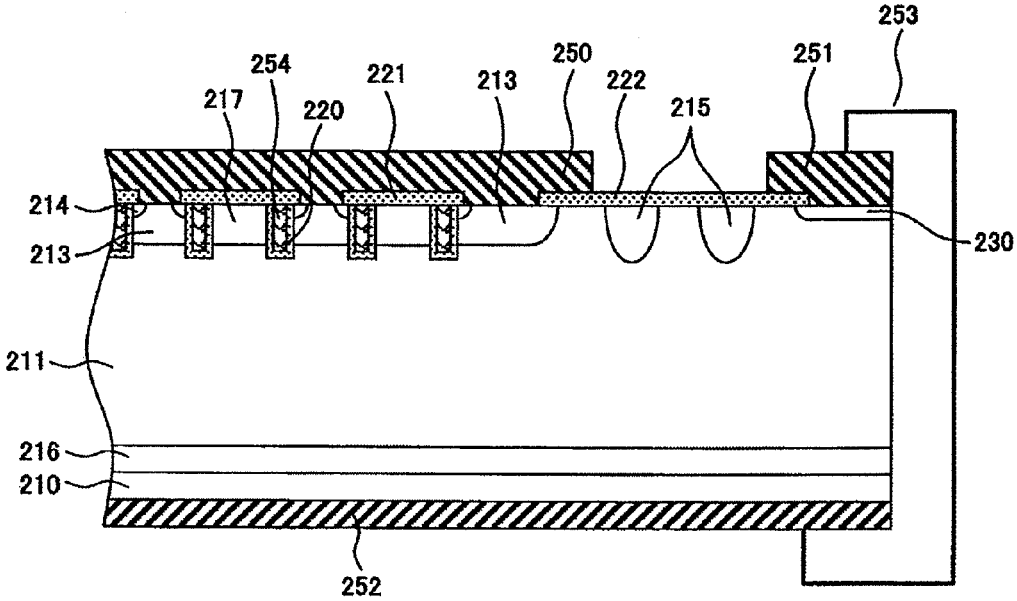
FIG. 11 shows an embodiment of the IGBT having the reverse-conductive diode incorporated therein, which is used as a clamping element for the plasma display device according to the present invention.

FIG. 11 shows an embodiment applicable to the reverse-conductive IGBTs 301 and 302 of FIG. 10. A reverse-conductive IGBT includes an n-layer 216 in contact with a p-layer 210, a p-layer 213 and a p-layer 217 diffused into an $n^-$-layer 211 contacting with the n-layer 216, and an $n^+$-layer 214 formed in a p-layer 213. A collector electrode 252 contacts with the p-layer 210 in a state of low resistance. The p-layer 210 and the n-layer 216 may be formed by being diffused into the $n^-$-layer 211 formed by a floating-zone (FZ) method, or crystal growth of an epitaxial layer of the n-layer 216 and the $n^-$-layer 211 may be developed on the $p^+$-substrate 210. The former method of using an $n^-$-substrate formed by the FZ method is more inexpensive. A trench-shaped gate electrode 254 is formed via a gate insulating film 220 in contact with the $n^+$-layer 214, the p-layer 213, and the $n^-$-layer 211. Around an outer perimeter of the reverse-conductive IGBT, an $n^+$-layer 230 is formed as a channel-stopper layer that suppresses an extension of a depletion layer in a termination area. A cathode electrode 251 contacts with this $n^+$-layer 230 in a state of low resistance. Between the $n^+$-layer 230 and its nearby p-layer 213, a Field Limiting Ring (FLR) made of a p-layer 215 is formed to ensure the breakdown voltage of the reverse-conductive IGBT. The cathode electrode 251 is electrically connected to a collector electrode 252 in a state of low resistance by an electrical connecting wiring 253, whereby, a diode for reverse conducting can be incorporated between the p-layer 213 and the $n^+$-layer 230. A connecting method includes, for example, wire bonding and soldering.

Next, a preferable embodiment of the bi-directional switch element is described.

In the bi-directional switch 402 shown in FIG. 1, an IGBT 3*a* and a diode 3*b* connected in series and an IGBT 4*a* and a diode 4*b* connected in series are connected to each other in inverse parallel. Therefore, when a current flows through the IGBT 3*a* and the diode 3*b* of the bi-directional switch, a diffusion potential of approximately 1V for forward-biasing a pn-junction of the diode 3*b* and a diffusion potential of approximately 1V for forward-biasing a pn-junction on a collector side of the IGBT 3*a* doubly occur, thereby disadvantageously causing a large power loss.

Figure 12:
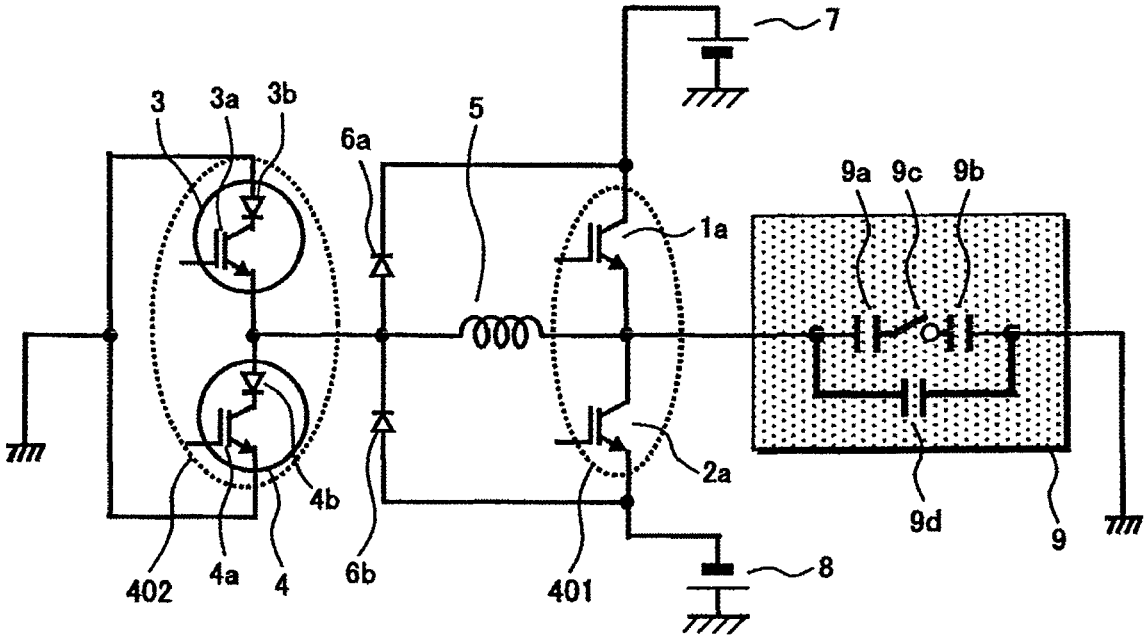
FIG. 12 is a drawing of an embodiment of the plasma display device according to the present invention in which an IGBT having a reverse-blocking diode incorporated therein is used as a bi-directional switch element.

FIG. 12 shows a driving circuit using a structure in which a reverse-blocking diode is integrated in an IGBT (hereinafter referred to as a reverse-blocking IGBT). Reverse-blocking IGBT 3 and 4 are used as the pn-junction of the diodes 3*b* and 4*b* and as the pn-junction of the IGBTs 3*a* and 4*a*. Therefore, conventionally double pn-junctions are reduced to one junction, thereby eliminating a voltage drop of approximately 1V, significantly reducing a loss, and also reducing the number of components.

Figure 13:
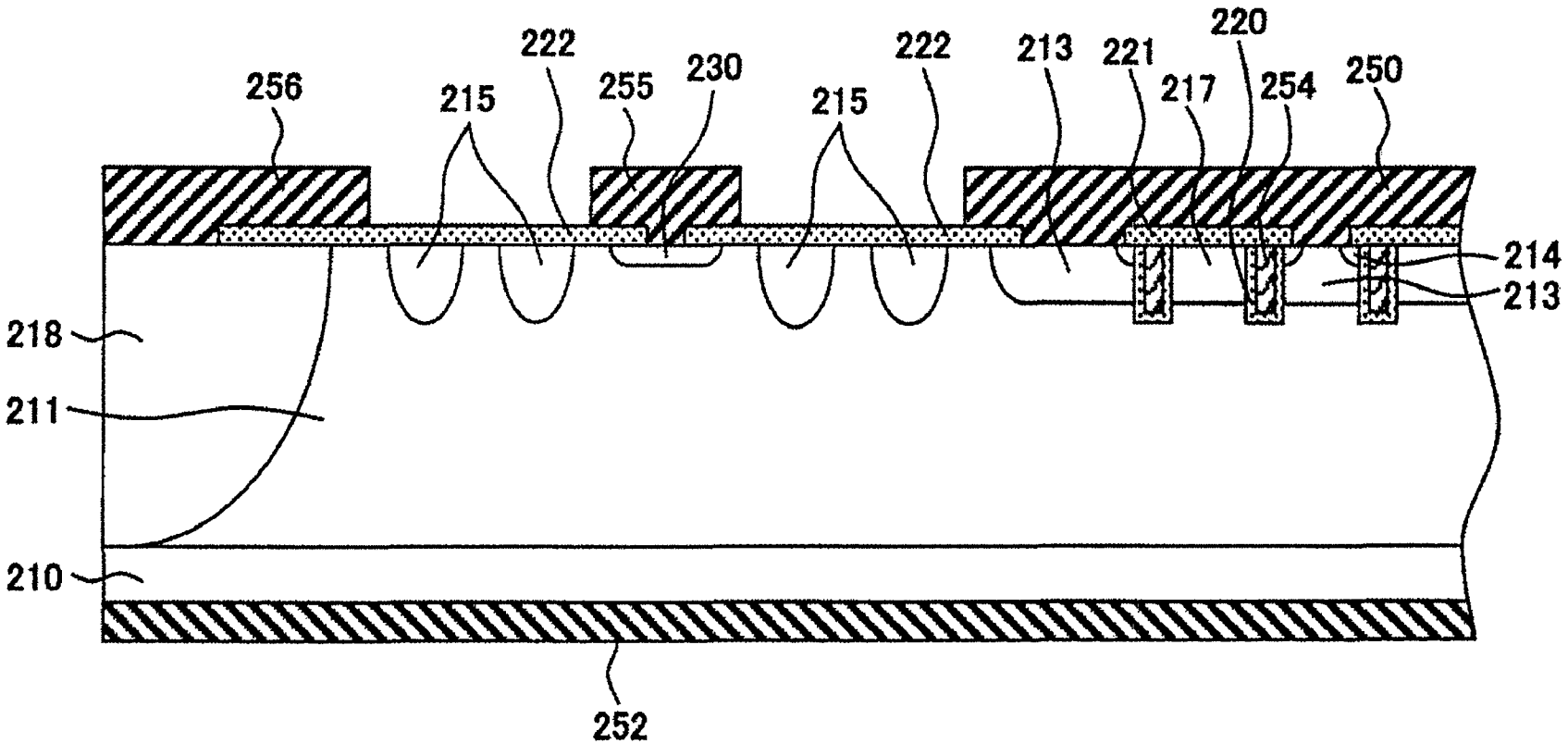
FIG. 13 shows an embodiment of the IGBT having the reverse-blocking diode incorporated therein, which is used as a bi-directional switch element for the plasma display device according to the present invention.

FIG. 13 shows an embodiment of reverse-blocking IGBTs 303 and 304 of the bi-directional switch 402. The reverse-blocking IGBT includes a $p^+$-layer 218 diffused in an $n^-$-layer 211 contacting with a $p^+$-layer 210 around an outer perimeter of the chip, an anode electrode 256 contacting with the $p^+$-layer 218 in a state of low resistance, a cathode electrode 255 contacting with an $n^+$-layer 230 in a state of low resistance, and other elements. The $p^+$-layer 210 may be formed by diffusing the $p^+$-layer 210 into the $n^-$-substrate 211 formed by the FZ method, and may be formed by forming an epitaxial-grown silicon crystal of the $n^-$-layer 211 on the $p^+$-substrate 210. The former method using an $n^-$-substrate formed by the FZ method is more inexpensive. In an IGBT area, a trench-type gate insulating film 220 and a gate electrode 254 are formed. Between each of the p-layer 210 and $p^+$-layer 218, and the $n^+$-layer 230, a pn-diode reversely-connected are formed. In this reverse-blocking IGBT, the breakdown voltage in a forward direction is mainly achieved between the p-layer 213 and the $n^-$-layer 211. On the other hand, the breakdown voltage in a reverse direction is mainly ensured between each of the $p^+$-layer 210 and $p^+$-layer 218, and the $n^-$-layer 211. As a result, the diode of the bi-directional switch shown in FIG. 12 is not required, and the voltage applying to one diode in a forward direction is reduced from the bi-directional switch 402, thereby achieving a reduction in loss of the driving circuit and a reduction in the number of components.

In a further preferable embodiment of the bi-directional switch element, a bi-directionally-conductive IGBT (hereinafter referred to as a bi-directional IGBT) is used.

Figure 14:
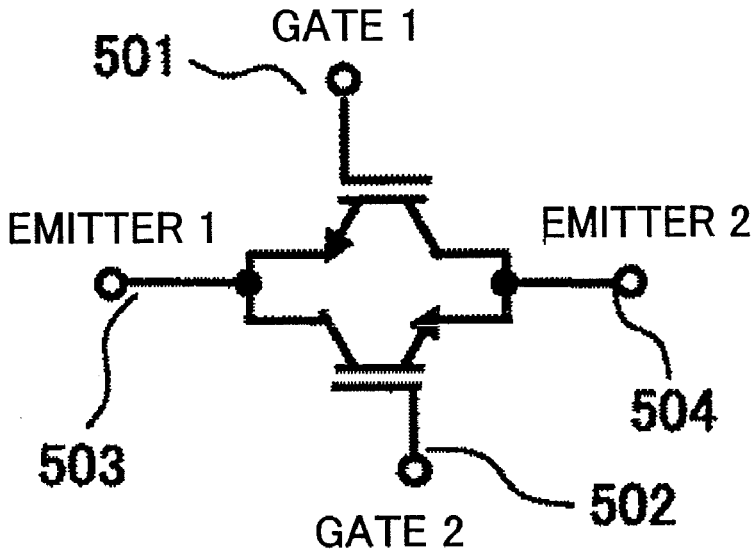
FIG. 14 is a drawing of an equivalent circuit of a bi-directional IGBT used as a bi-directional switch element for the plasma display device according to the present invention.
Figure 15:
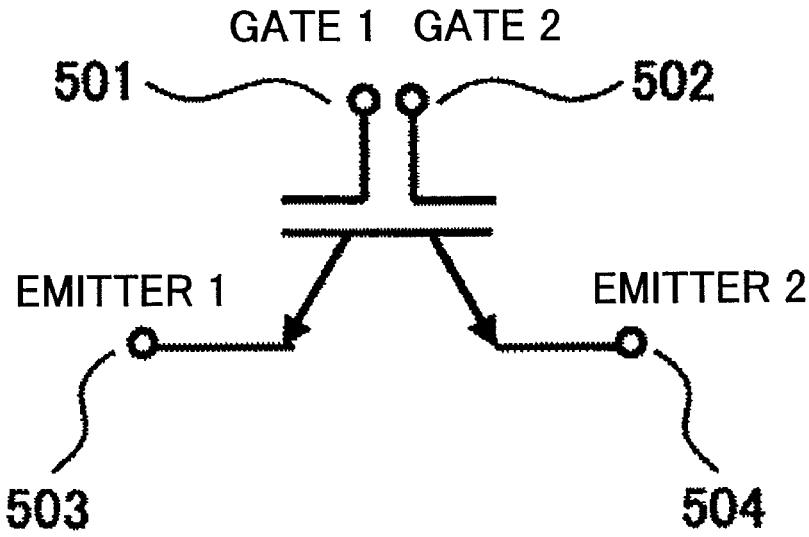
FIG. 15 is a drawing of symbols of the bi-directional IGBT used as a bi-directional switch element for the plasma display device according to the present invention.
Figure 16:
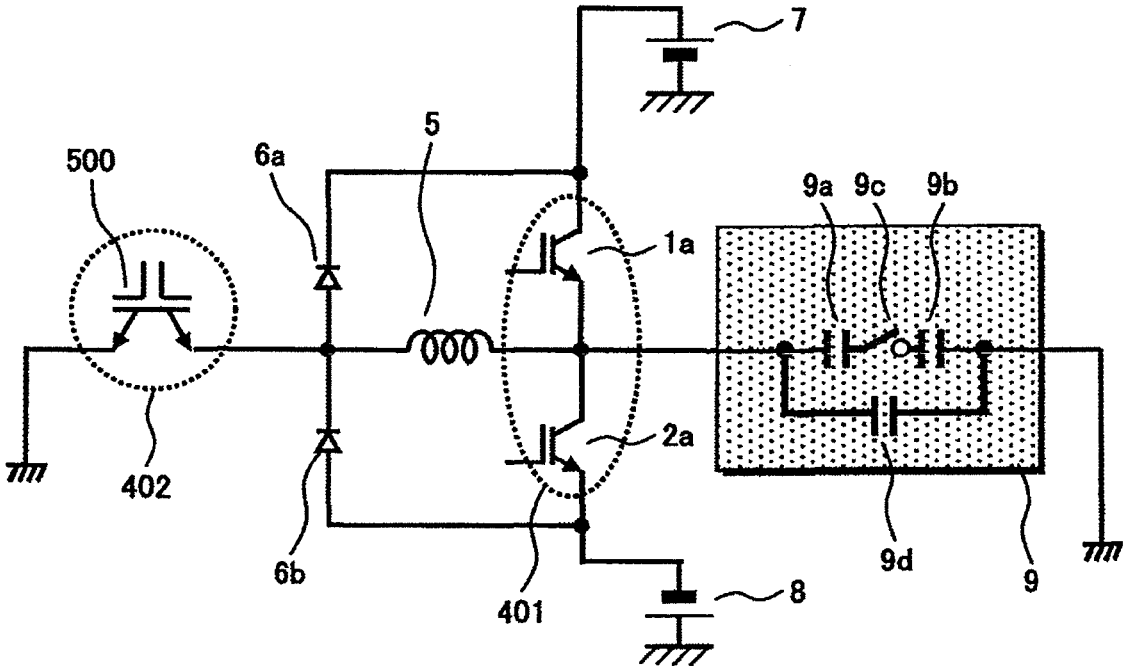
FIG. 16 is a drawing of an embodiment of the plasma display device according to the present invention in which a bi-directional IGBT is used as a bi-directional switch element.

FIG. 14 shows an equivalent circuit of a bi-directional IGBT. The bi-directional IGBT can control bi-directional currents by a gate, and is hereinafter denoted by circuitry symbols in FIG. 15. FIG. 16 shows a driving circuit using a bi-directional IGBT 500 as a bi-directional switch.

Figure 17:
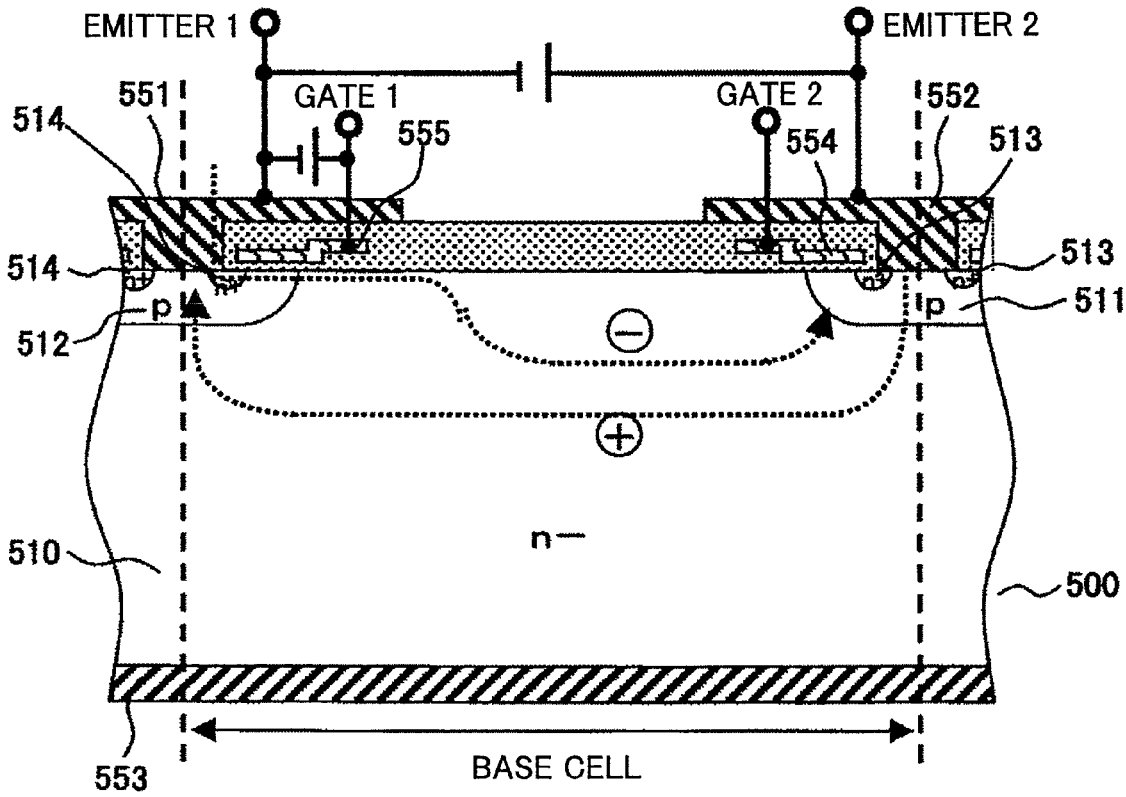
FIG. 17 shows an embodiment of the bi-directional IGBT used as a bi-directional switch element for the plasma display device according to the present invention, and also shows an internal state at the time of conduction.

FIG. 17 shows a structure describing one embodiment of the bi-directional IGBT and schematically shows an internal state at the time of conduction. The operation principle of the bi-directional IGBT is described with reference to this drawing.

It is assumed herein that an emitter-2 electrode 552 has a higher potential than that of an emitter-1 electrode 551.

To carry a current from the emitter-2 electrode 552 to the emitter-1 electrode 551, while a positive voltage with respect to the emitter-1 electrode is applied to the emitter-2 electrode 552, a positive voltage with respect to the emitter-1 electrode 551 is applied to a gate-1 electrode 555. When the voltage applied to the gate-1 electrode 555 is equal to or higher than a threshold voltage, a channel layer is formed under the gate-1 electrode 555. Electrons are then injected to an $n^-$-layer 510 from an $n^+$-layer 514 on an emitter-1 electrode 551 side through the channel. With this electron current, a junction between a p-layer 511 on an emitter-2 electrode 552 side and an $n^-$-layer 510 is forward-biased, thereby causing holes to be injected from the p-layer 511 to the $n^-$-layer 510. As a result, there are excessive injected electrons and holes in the $n^-$-layer 510, thereby significantly decreasing the resistance and completing conductivity modulation.

To turn off the current flowing from the emitter-2 electrode 552 to the emitter-1 electrode 551 to cause a OFF-state, the positive voltage with respect to the emitter-1 electrode 551 applied to the gate-1 electrode 555 at the time of conduction is set to be equal to or lower than a threshold voltage. As a result, the channel under the gate-1 electrode 555 disappears, thereby stopping an electron current from the $n^+$-layer 514 on the emitter-1 electrode 551 side to the $n^-$-layer 510 and also stopping injection of holes from the p-layer 511. The carriers accumulated in the $n^-$-layer 510 are discharged with the spread of a depletion layer and then disappear through recombination. The potential of the gate-2 electrode 554 at the time of the above-described operation will be described further below. When the emitter-1 electrode 551 has a higher potential than that of the emitter-2 electrode 552, the gate-2 electrode 554 is to be controlled, and a similar operation is performed.

In the driving circuit of FIG. 12 using a reverse-blocking IGBT as a bi-directional switch, the reverse-blocking IGBT can carry a current only in one direction, and therefore two reverse-blocking IGBTs are connected to each other in inverse parallel. By contrast, in the circuit of FIG. 16 using a bi-directional IGBT as a bi-directional switch, driving can be performed with only one bi-directional IGBT, thereby further reducing the number of components.

Also, in the bi-directional switch using a reverse-blocking IGBT, in ON-state, the current can be carried only in a conductive area of one reverse-blocking IGBT. By contrast, in the bi-directional IGBT, a bi-directional current can be passed in all conductive areas in the element, thereby further achieving loss reduction.

Figure 40:
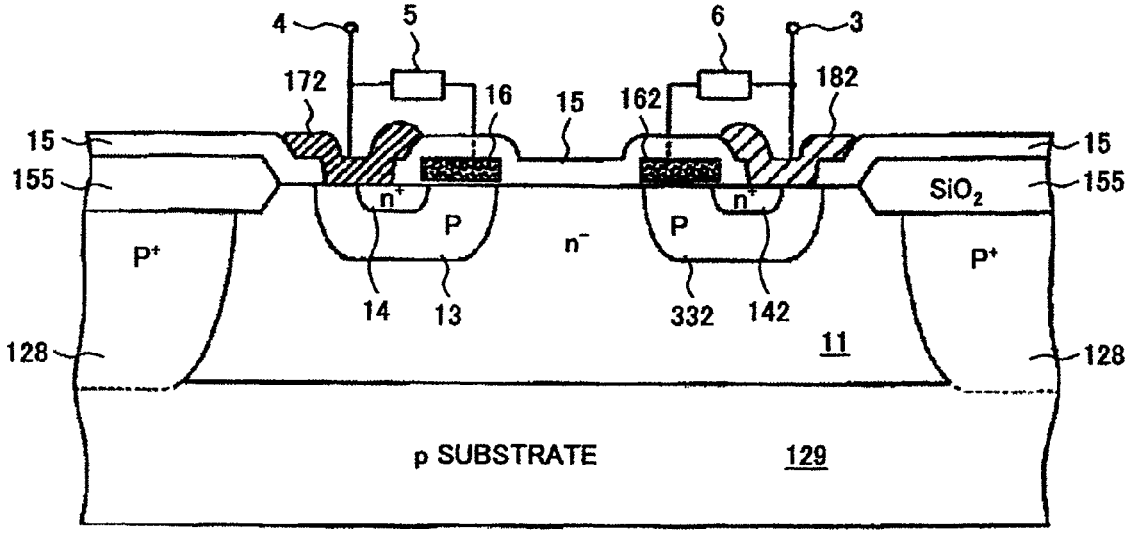
FIG. 40 shows a structure of a conventional bi-directional IGBT.

The structure of the bi-directional IGBT is disclosed in Japanese Patent No. 3352840, as shown in FIG. 40. A method of driving a gate disclosed in the patent gazette is as described in the embodiment shown in FIG. 17 and is about a method of driving a current-control gate on a low potential side. However, the present inventors have found that, in order to sufficiently take advantage of the performance of the bi-directional IGBT, it is necessary to control a gate on a high potential side.

Figure 18:
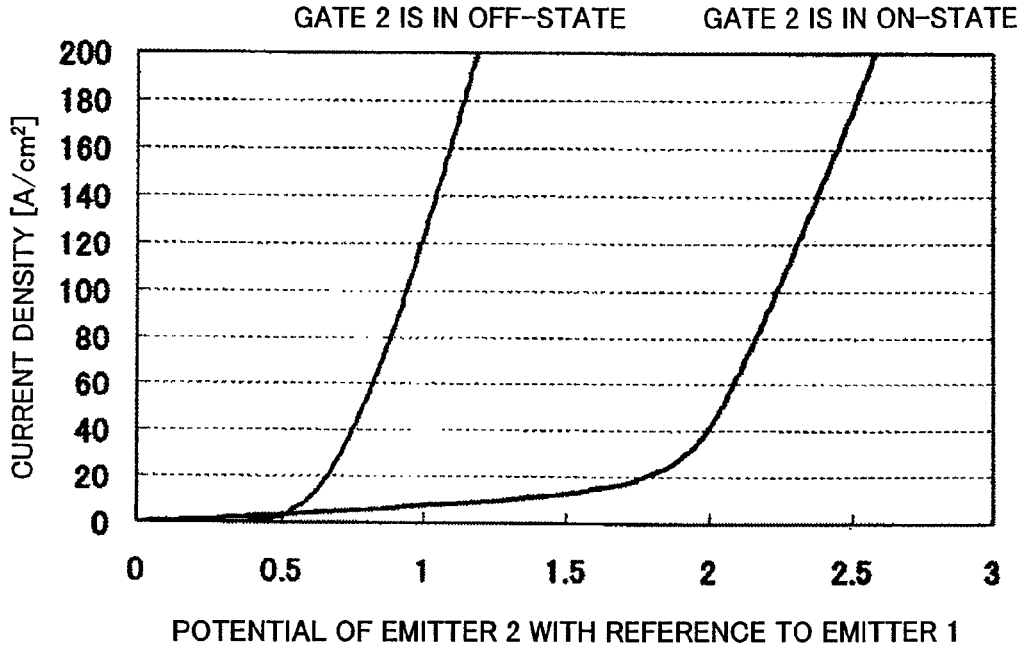
FIG. 18 shows output characteristics of the bi-directional IGBT used as a bi-directional switch element for the plasma display device according to the present invention.

FIG. 18 shows output characteristics of the bi-directional IGBT with the structure of FIG. 17 when the gate-1 electrode 555 is turned on to cause a current to flow from the emitter-2 electrode 552 to the emitter-1 electrode 551. The result shows that the output characteristics are improved when the gate-2 electrode 554 is turned to be an OFF-state compared to when the gate-2 electrode 554 is turned to be an ON-state. The reason is as follows. That is, when the gate-2 electrode 554 is turned ON, a short circuit occurs between the n-layer 510 and the p-layer 511. Therefore, a forward bias is not applied to the pn-junction, and holes tend not to be injected. To get solve this problem, the present inventors have found that the gate-2 electrode 554 is preferably turned to be an OFF-state when a current is caused to flow from the emitter-2 electrode 552 to the emitter-1 electrode 551.

Figure 19:
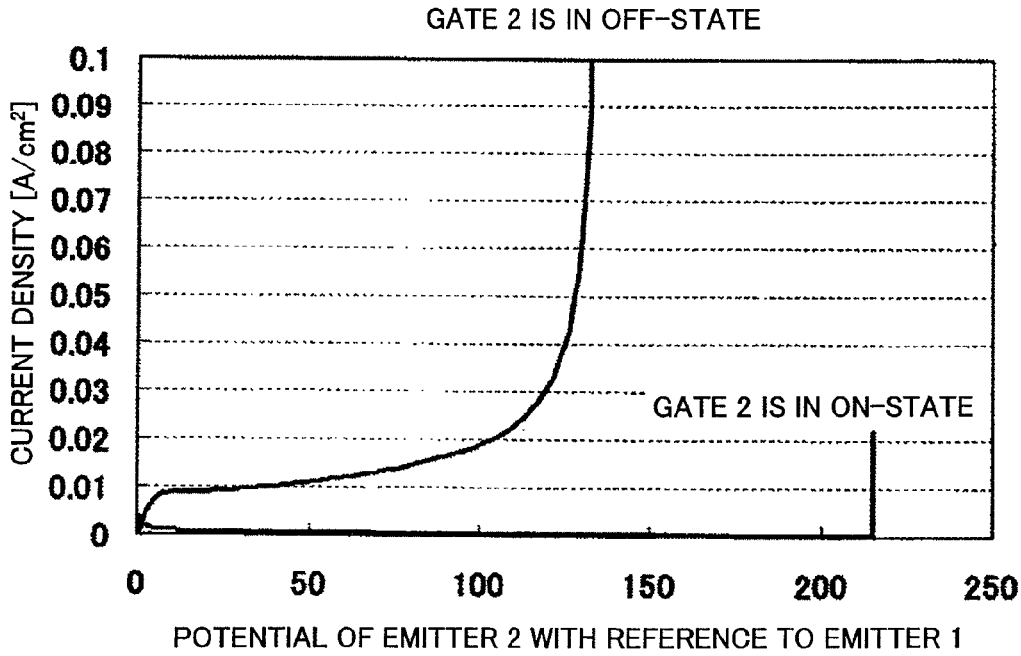
FIG. 19 shows blocking characteristics of the bi-directional IGBT used as a bi-directional switch element for the plasma display device according to the present invention.

FIG. 19 shows blocking characteristics of the bi-directional IGBT with the structure of FIG. 17 when the gate-1 electrode 555 is turned off in a state that the emitter-2 electrode 552 has a potential higher than that of the emitter-1 electrode 551. The result shows that a leak current is small and a breakdown voltage is high when the gate-2 electrode 554 is turned to be an ON-state compared to when the gate-2 electrode 554 is turned to be an OFF-state. The reason is as follows. That is, when the gate-2 electrode 554 is turned ON, a short circuit occurs between the n-layer 510 and the p-layer 511. Therefore, a forward bias is not applied to their pn-junction, and holes tend not to be injected. To solve this problem, the present inventors have found that the gate-2 electrode 554 is preferably turned to be an ON-state at the time of a blocking state where the emitter-2 electrode 552 has a potential higher than that of the emitter-1 electrode.

From the above description, it is preferable that the gate-1 electrode 555 and the gate-2 electrode 554 are controlled as shown in FIGS. 20A and 20B according to a potential relation between the emitter-1 electrode 551 and the emitter-2 electrode 552 and their conducting state and blocking state.

Also, it has been found that the bi-directional IGBT structure of FIG. 40 disclosed in Japanese Patent No. 3352840 is not suitable for the half-bridge driving method according to the present invention in which the breakdown voltage is at least equal to or higher than 300V.

Figure 21A:
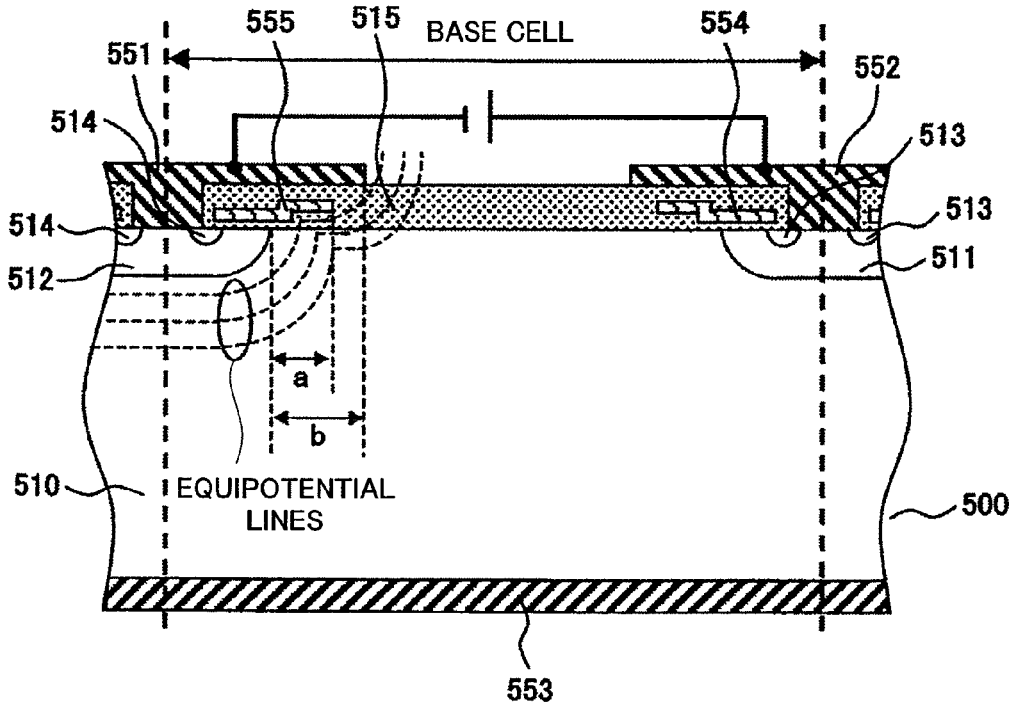
FIG. 21A shows an embodiment of the bi-directional IGBT according to the present invention, which is used as a bi-directional switch element for the plasma display device according to the present invention.
Figure 21B:
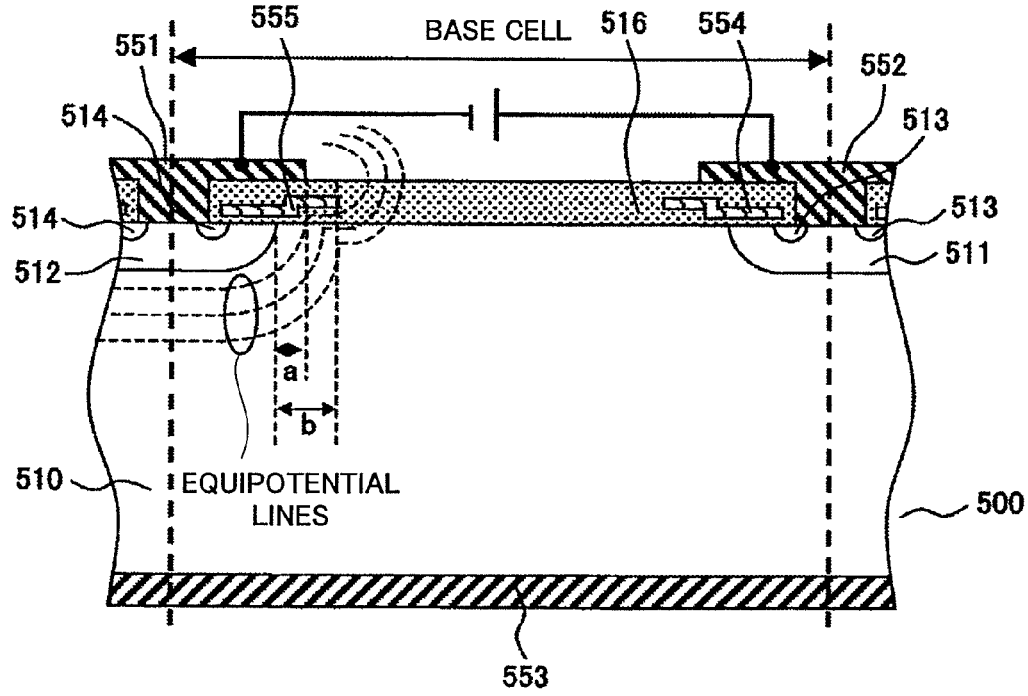
FIG. 21B shows an embodiment of the bi-directional IGBT according to the present invention, which is used as a bi-directional switch element for the plasma display device according to the present invention.

FIGS. 21A and 21B each show an internal state in a blocking state of the bi-directional IGBT shown in FIG. 17. In a blocking state, a depletion layer develops from a junction of the p-layer 512 and the $n^-$-layer 510. Here, it is assumed that a distance from an end of the p-layer 512 to an end of the gate-1 electrode 555 is a, whilst a distance from the end of the p-layer 512 to an end of the emitter-1 electrode 551 is b. The present inventors have found that, in order to ensure a breakdown voltage equal to or higher than 300V, as shown in FIG. 21A, a<b relation is required with a structure in which the emitter-1 electrode overlaps the gate-1 electrode 555. If a>b as shown in FIG. 21B, in a blocking state, when a positive voltage with respect to the emitter-1 electrode 551 is applied to the emitter-2 electrode 552, an equipotential line of a depletion layer occurring at the junction of the p-layer 512 and the $n^-$-layer 510 turns around from the gate-1 electrode 555 to the emitter-1 electrode 551. Therefore, the electric field intensity at a corner of the gate-1 electrode 555 is increased to cause an avalanche. The structure of FIG. 40 disclosed in Japanese Patent No. 3352840 has an a>b relation. Therefore, it has been found that this structure is not suitable for the bi-directional switch element in the half-bridge driving method according to the present invention in which the breakdown voltage is at least equal to or higher than 300V.

Figure 22:
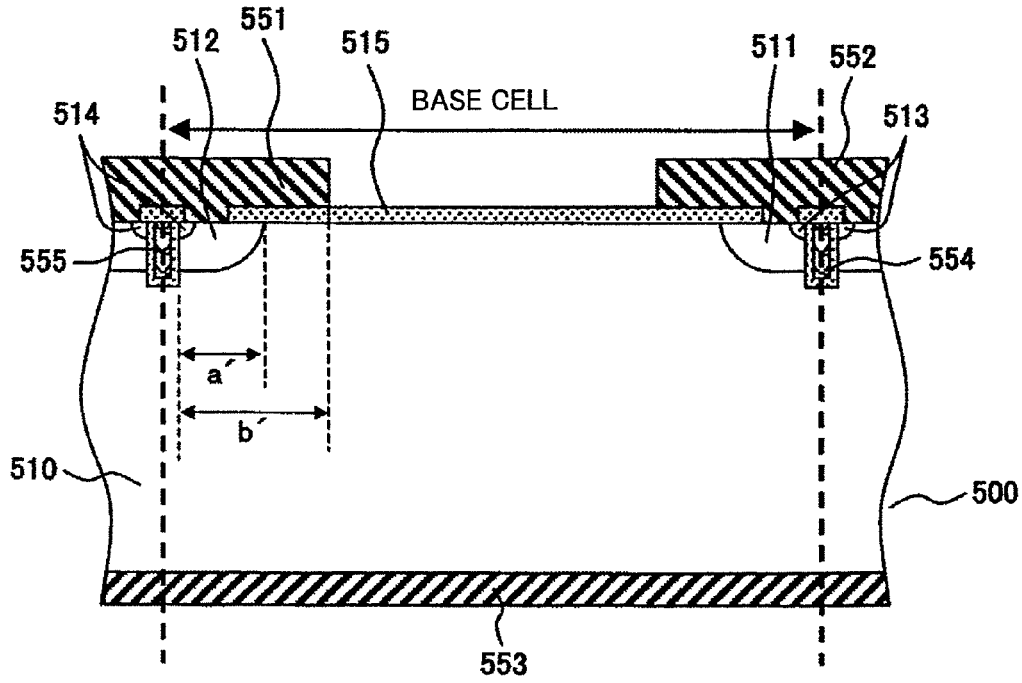
FIG. 22 shows an embodiment of the bi-directional IGBT having a trench gate according to the present invention, which is used as a bi-directional switch element for the plasma display device according to the present invention.

FIG. 22 shows an embodiment of the bi-directional IGBT with a feature in which an insulating gate has a trench-gate structure. In the trench-gate structure, a channel layer is formed in a vertical direction, and therefore, microfabrication can be achieved in a lateral direction, compared with a planar-gate structure. Thus, the cell size can be reduced, the forward voltage can be further dropped, and the loss of the driving circuit according to the present invention can be reduced.

Furthermore, when it is assumed that a distance from the gate-1 electrode 555 with a trench structure to an end of the p-layer 512 is a', whilst a distance from the gate-1 electrode 555 with a trench structure to the emitter-1 electrode 551 is b'. In order to ensure the breakdown voltage, a'<b' relation is desirable. The reason is the same as described in the description of FIGS. 21A and 21B. If a'>b', in a blocking state, an equipotential line of a depletion layer occurred at the junction of the p-layer 512 and the $n^-$-layer 510 turns around to the emitter-1 electrode 551 to cause an avalanche at the end of the p-layer 512. With a'<b', the breakdown voltage is increased, and the element can be the one suitable for the half-bridge method according to the present invention in which a high breakdown voltage of the element is required.

Figure 23:
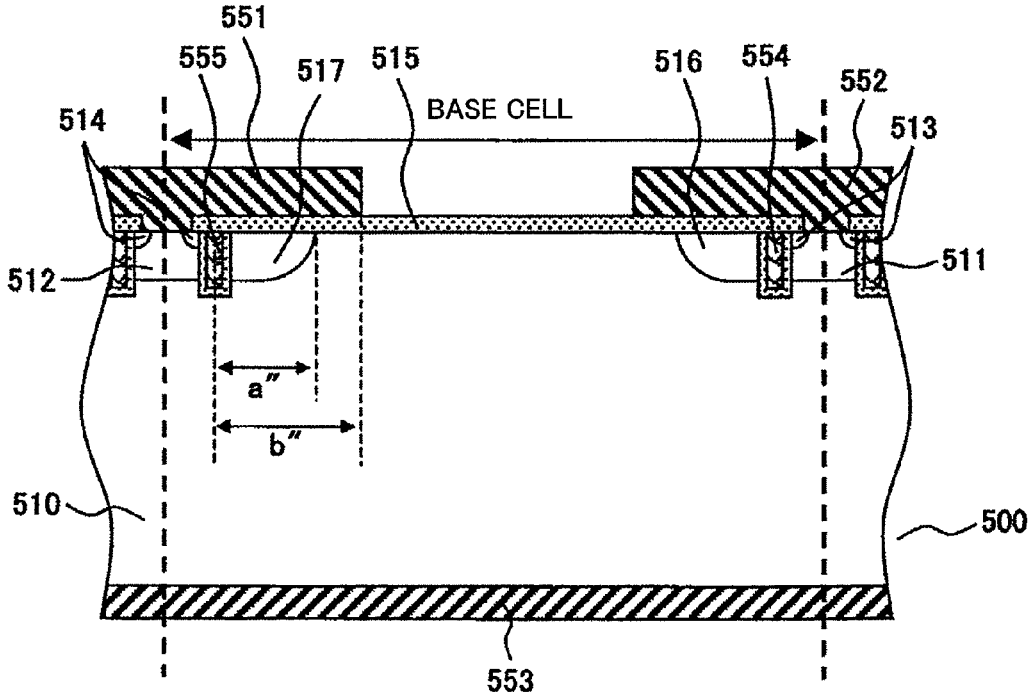
FIG. 23 shows another embodiment of the bi-directional IGBT having a trench gate according to the present invention, which is used as a bi-directional switch element for the plasma display device according to the present invention.

FIG. 23 shows another embodiment of the bi-directional IGBT with an insulating gate having a trench-gate structure. This embodiment has a feature in which the gate-1 electrode 555 with a trench structure exists between a region where the emitter-1 electrode 551 and the p-layer 512 contact with each other and the emitter-2 electrode 552, and floating p-layers 516 and 517 are provided.

With the provision of the floating p-layers, effects similar to those in the embodiment of FIG. 7 can be achieved to promote conductivity modulation. Therefore, the forward voltage can be dropped, and also the loss of the half-bridge driving circuit according to the present invention can be reduced.

Also, when it is assumed that a distance from the gate-1 electrode 555 with a trench structure to an end of the floating p-layer 517 is a", whilst a distance from the gate-1 electrode 555 with a trench structure to the emitter-1 electrode 551 is b". In order to ensure the breakdown voltage, a"<b" relation is desirable. The reason is as described in the description of FIGS. 21A and 21B. If a">b", in a blocking state, an equipotential line of a depletion layer occurred at the junction of the p-layer 517 and the $n^-$-layer 510 turns around to the emitter-1 electrode 551 to cause an avalanche at the end of the p-layer 517. With a"<b", the breakdown voltage is increased, and the element can be the one suitable for the half-bridge method according to the present invention in which a high breakdown voltage of the element is required.

Figure 24:
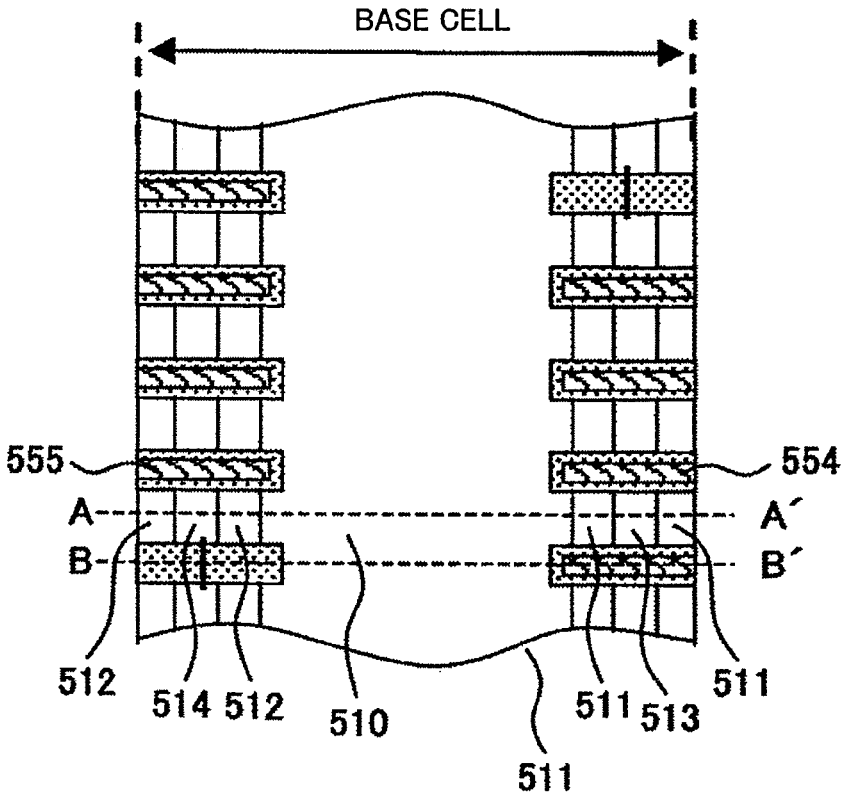
FIG. 24 is a top face view of still another embodiment of the bi-directional IGBT having a trench gate according to the present invention, which is used as a bi-directional switch element for the plasma display device according to the present invention.

FIG. 24 is a top face view of still another embodiment of the bi-directional IGBT in which an insulating gate has a trench-gate structure.

Figure 25:
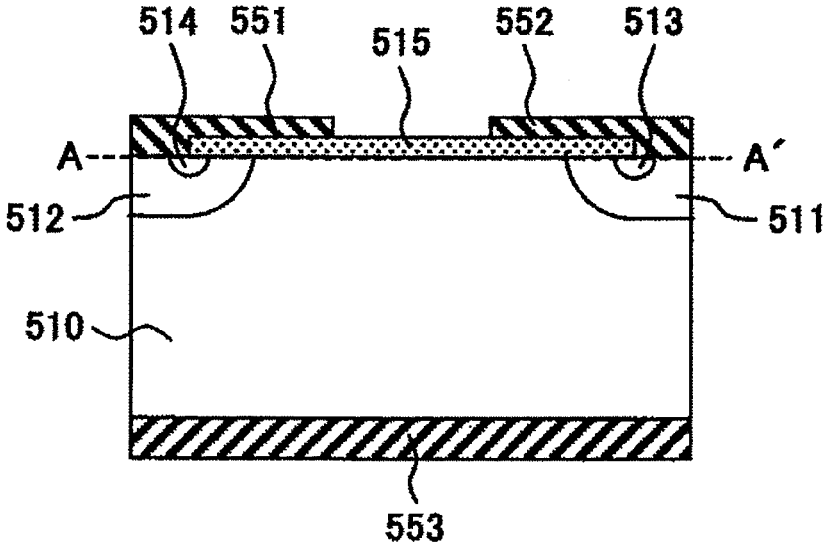
FIG. 25 is a cross-section view of the bi-directional IGBT taken along an A-A' line in FIG. 24.
Figure 26:
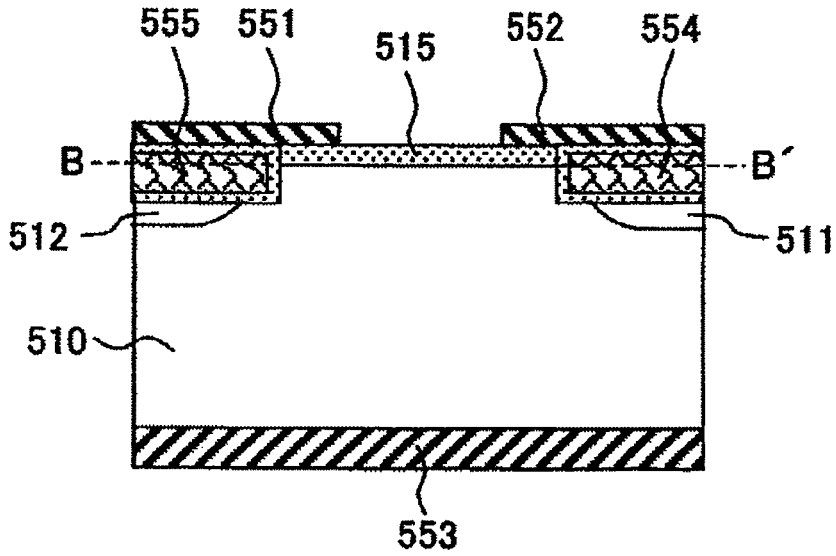
FIG. 26 is a cross-section view of the bi-directional IGBT taken along a B-B' line in FIG. 24.

FIG. 25 is a cross-sectional view of the bi-directional IGBT in FIG. 24 along an A-A' line, FIG. 26 is a cross-section view of the bi-directional IGBT in FIG. 24 taken along a B-B' line. The structure has a feature in which the gate width can be increased compared with the structure having a trench gate as in FIGS. 22 and 23, thereby significantly reducing a channel resistance. Therefore, the forward voltage can be dropped, and the loss of the half-driving circuit according to the present invention can be further reduced.

Figure 27:
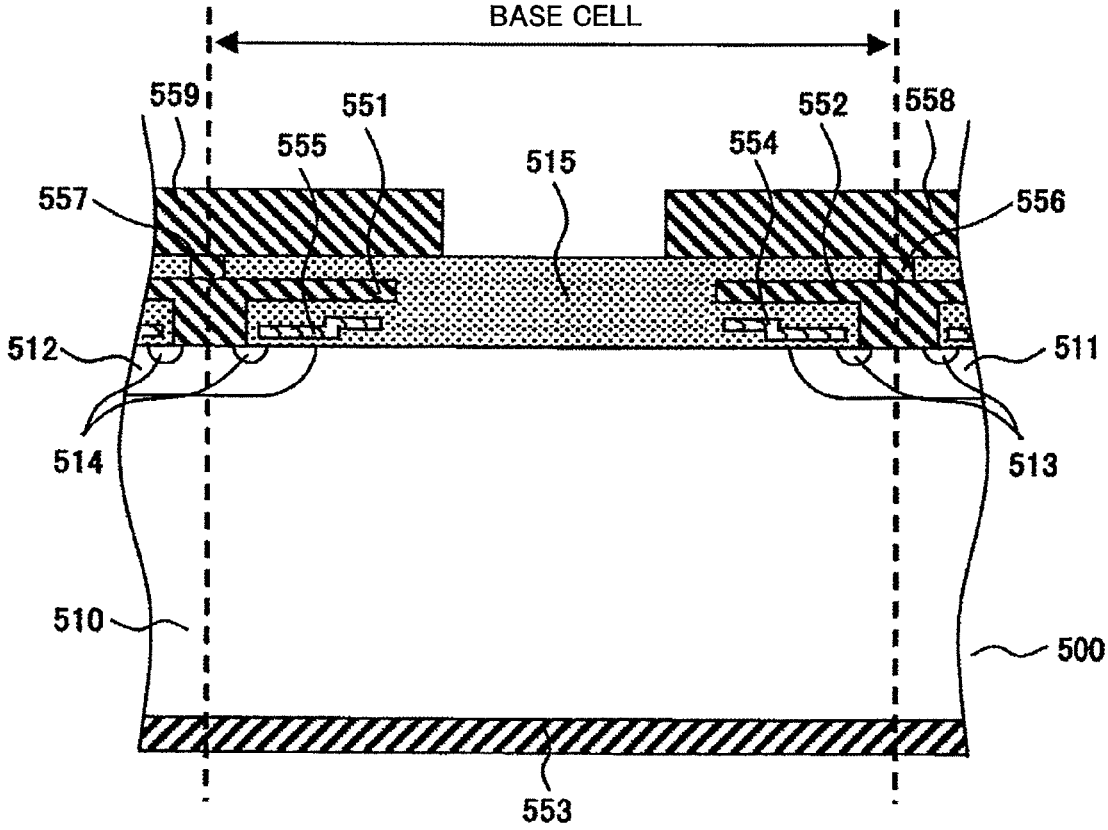
FIG. 27 shows an embodiment of a wiring method for the bi-directional IGBT used as a bi-directional switch element for the plasma display device according to the present invention.

The above-described bi-directional IGBT has a structure in which a current flows in a lateral direction. Therefore, wiring of the emitter-1 electrode 551 and the emitter-2 electrode 552 on the element surface has to be extended to a pad area where wire bonding is performed. In the half-bridge driving method according to the present invention, the current flowing through the bi-directional switch is larger than that in the conventional full-bridge driving method, and therefore the chip size is increased, and the resistance of the wiring of the emitter-1 electrode and the emitter-2 electrode is not negligible. For this reason, as shown in FIG. 27, in addition to the wiring layer of the emitter-1 electrode and the emitter-2 electrode, another wiring layer is formed on an insulating layer, and the emitter-1 electrode and the emitter-2 electrode are connected together via a through hole, thereby desirably decreasing the wiring resistance.

Furthermore, when mounting it on a bi-directional IGBT package, electrical connection of electrodes has to be carefully performed.

When mounting the elements with the structure of the bi-directional IGBT of FIG. 17 on a package, a board electrode 553 is soldered to the frame. Unless the board electrode 553 is electrically insulated from the emitter-1 electrode or the emitter-2 electrode, in a blocking state, a leak current flows via the board. Also, unless the board electrode is electrically insulated from the gate-1 electrode or the gate-2 electrode, in a blocking state, a high voltage is disadvantageously applied to a gate-oxide film, so that it is destroyed.

Figure 28:
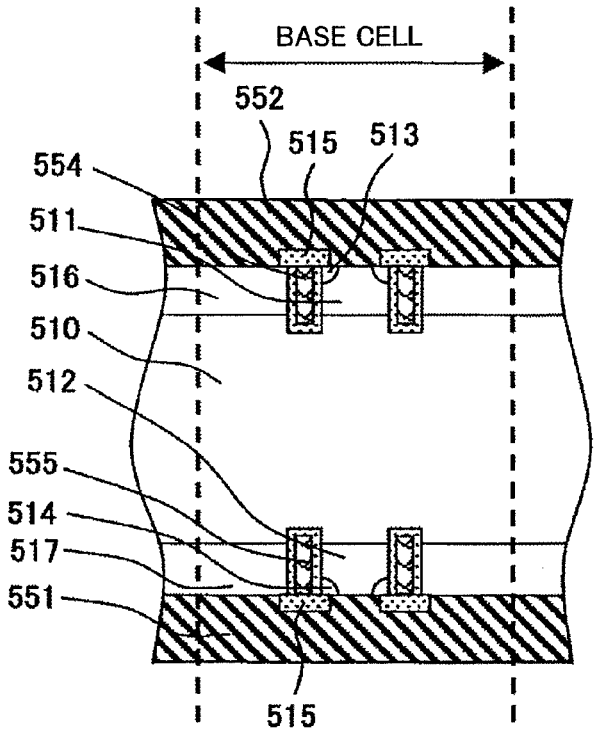
FIG. 28 shows an embodiment of a vertical type bi-directional IGBT used as a bi-directional switch element for the plasma display device according to the present invention.

FIG. 28 shows one embodiment of the bi-directional IGBT.

In the above-described bi-directional IGBT structures, the current flows in a lateral direction. By contrast, in the present structure, the current flows in a vertical direction. In the structure in which the current flows in a lateral direction, in order to ensure the breakdown voltage in the lateral direction, the cell size has to be enough large. By contrast, in the present structure, the breakdown voltage is ensured in a vertical direction, thereby reducing the cell size. Thus, compared with the structure in which the current flows in a lateral direction, the forward voltage can be dropped, thereby further reducing the loss of the half-bridge driving circuit according to the present invention.

In the above-described bi-directional IGBT, it has been studied how the loss at the time of driving can be reduced by reducing the forward voltage. In order to further reduce the loss, the present inventors have found through studies that a reverse recovery current of the bi-directional IGBT has to be reduced.

Figure 29:
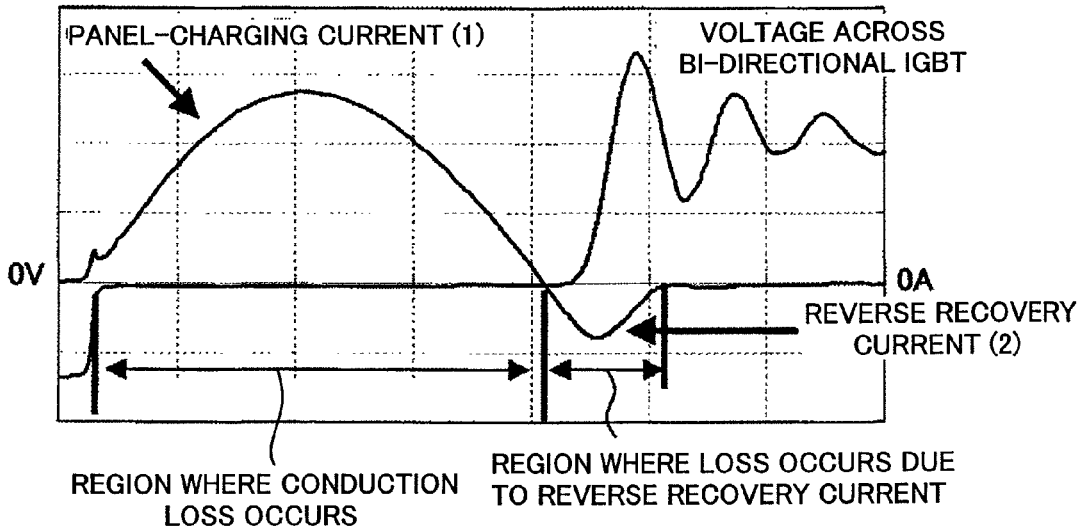
FIG. 29 shows a driving waveform of the bi-directional IGBT used as a bi-directional switch element for the plasma display device according to the present invention.

FIG. 29 shows an operation waveform of the bi-directional IGBT used as a bi-directional switch in the half-bridge driving method according to the present invention. The operation can be divided into a region carrying a panel-capacitance charging current (1) and a region carrying a reverse recovery current (2). In FIG. 16, the panel-capacitance charging current (1) flows when the bi-directional IGBT 500 is turned ON to charge the panel capacitance via the coil 5. The reverse recovery current (2) is a current which are internal carriers discharged by applying a voltage to the bi-directional IGBT 500 in a reverse direction with respect to the case of (1) when the bi-directional IGBT 500 as a clamping element is turned on after the panel-capacitance charging current (1) flows.

In the bi-directional IGBT 500, a loss occurs in each of the regions (1) and (2). The loss in the region (1) is a conductive loss, and therefore a forward voltage is dominant. The loss in the region (2) is due to a current flowing at the time of reverse recovery. Therefore, by decreasing the reverse recovery current, the loss can be further reduced.

The principles of the occurrence of a reverse recovery current are described below. FIG. 17 shows an internal state when a current flows from the emitter-2 electrode 552 to the emitter-1 electrode 551. From the p-layer 511, holes are injected, and a junction of the p-layer 511 and the $n^-$-layer 510 is in a state where carriers are highly concentrated. At the time of reverse recovery, a depletion layer develops from this $pn^-$-junction, and the carriers are discharged, so a reverse recovery current occurs. Therefore, in order to reduce the reverse recovery current, the carrier concentration near the junction of the p-layer 511 and the $n^-$-layer 510 at the time of conduction should be reduced.

Figure 30:
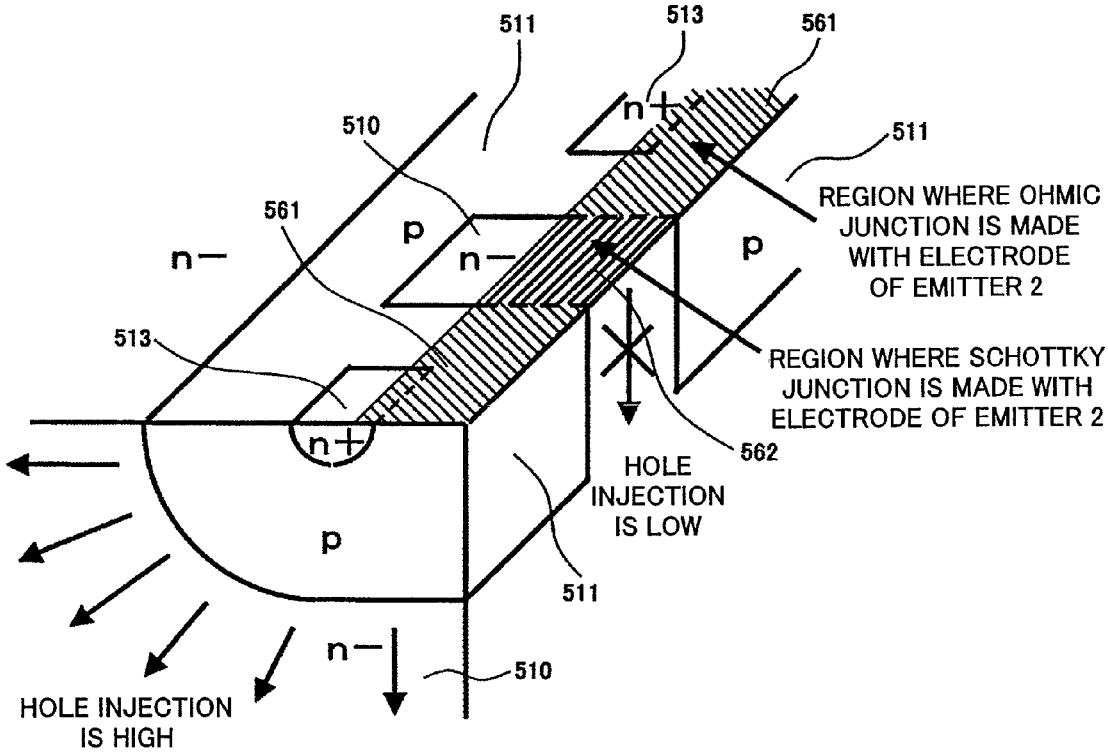
FIG. 30 shows an embodiment of a bi-directional IGBT having a Schottky junction according to the present invention, which is used as a bi-directional switch element for the plasma display device according to the present invention.

FIG. 30 shows a structure for reducing the reverse recovery current. This drawing is an enlarged view of a part of near the emitter-2 electrode 552 in the structure of FIG. 17 and, as with FIG. 17, shows an internal state when a current flows from the emitter-2 electrode 552 to the emitter-1 electrode 551. In this structure, a Schottky junction is provided between the emitter-2 electrode 552 and the $n^-$-layer 510. Since holes are not injected from such a junction, the carrier concentration near the junction between the p-layer 511 and the $n^-$-layer 510 can be reduced. Thus, the loss due to the reverse recovery current is reduced, and also noise due to the reverse recovery current is reduced, thereby achieving an easy-to-handle driving circuit with low loss.

Figure 31:
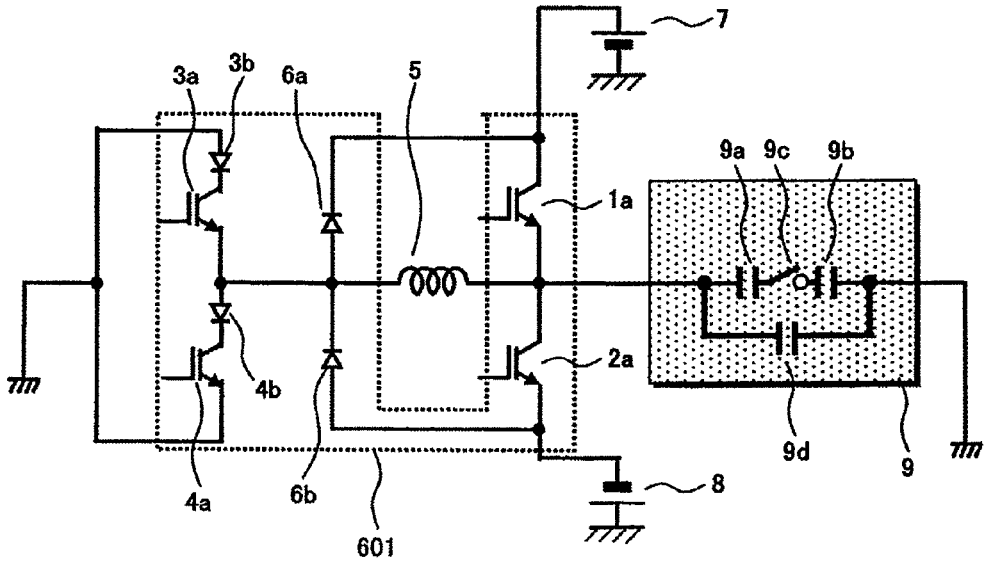
FIG. 31 shows an embodiment in which main elements of the plasma display device according to the present invention are mounted on one module.

As opposed to the conventional full-bridge driving method, the IGBT-based half-bridge driving method according to the present invention can significantly reduce the number of components. With switch elements surrounded in a broken line in FIG. 31 being mounted on one module, the number of components can be further reduced, and assembling process can be simplified. A heat-dissipating method includes a method using a heat-dissipating plate connected to the module and a method in which the module is fixed to a chassis.

If a gate driver IC that drives the switch element can be taken in the module, the number of components can be further reduced.

Here, in the IGBT-based half-bridge driving method according to the present invention, it has been found that there are problems as described below.

Figure 32:
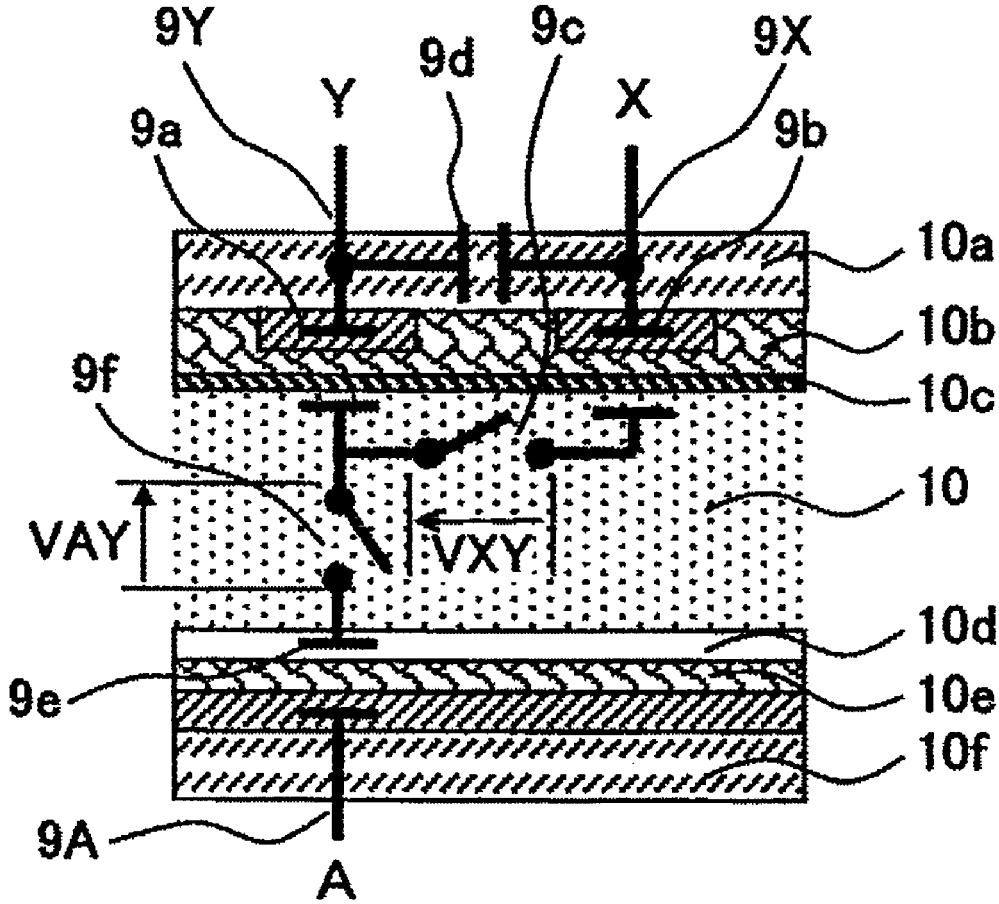
FIG. 32 shows a cell structure of a plasma display panel.
Figure 33:
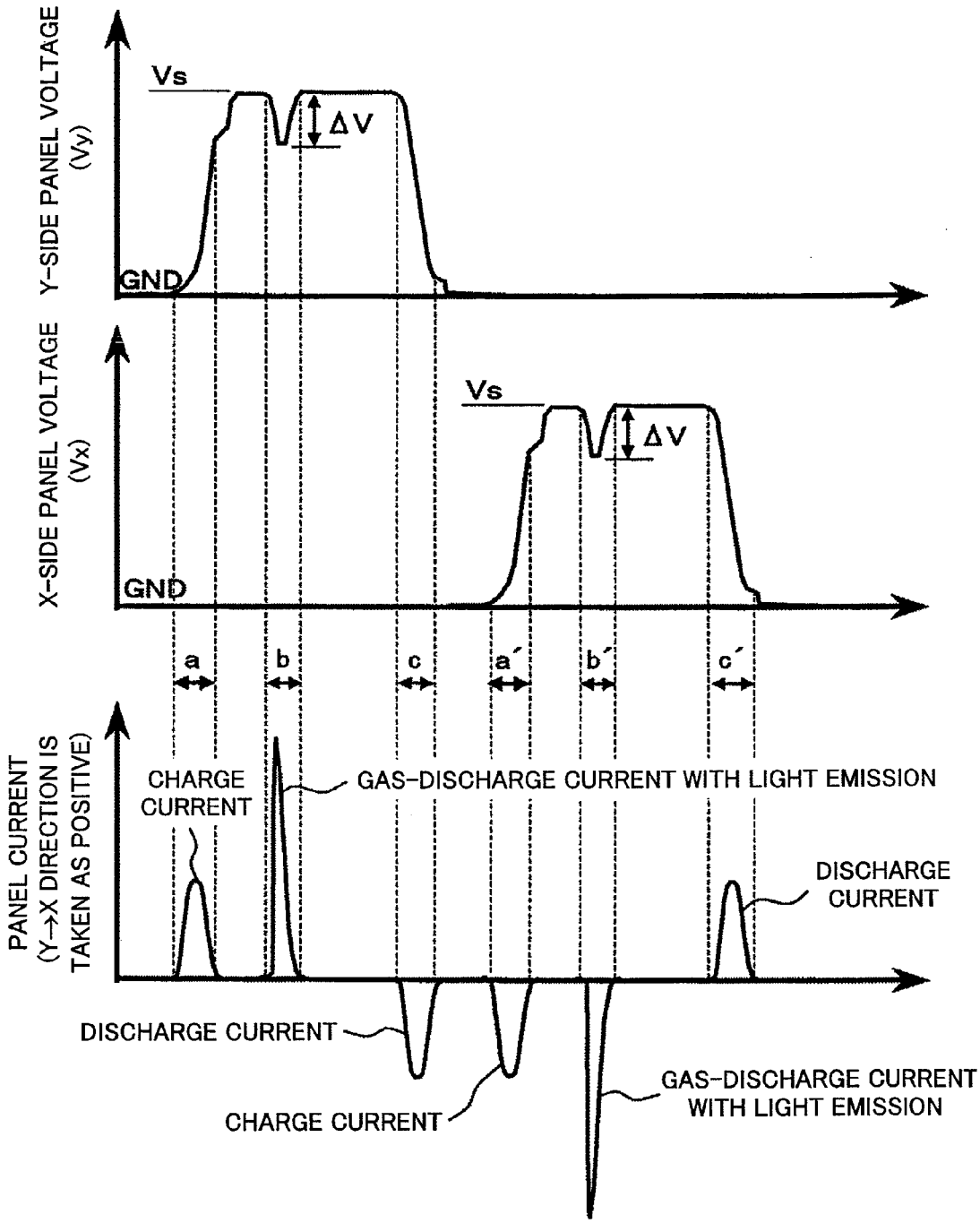
FIG. 33 shows driving waveforms of a conventional full-bridge driving method.
Figure 34A:
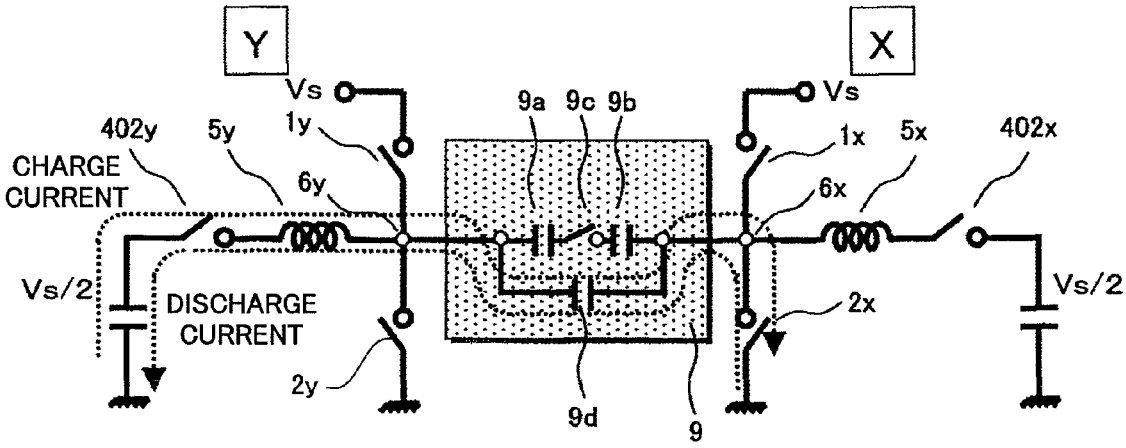
FIG. 34A shows a circuit and current paths in the conventional full-bridge driving method.
Figure 34B:
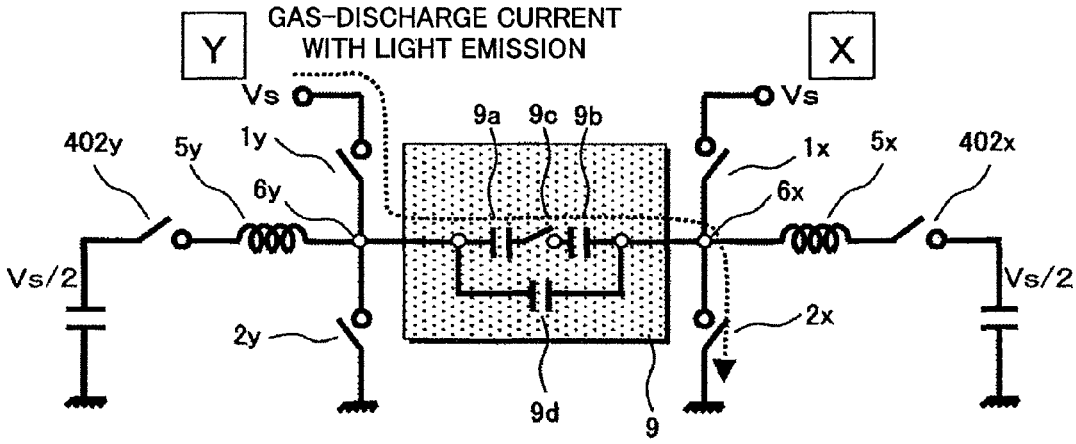
FIG. 34B shows a circuit and current paths in the conventional full-bridge driving method.

FIG. 32 shows an example of a cell structure of a plasma display panel. In the IGBT-based half-bridge driving method according to the present invention and also in the conventional full-bridge driving method, such a design is required as that a discharge is repeated between the Y electrode 9Y and the X electrode 9X during a sustain period for light emission of the panel but no discharge occurs between the Y electrode 9Y and the address electrode 9A. The reason is that a phosphorous layer is formed on the address electrode and, if a discharge is repeated between the Y electrode 9Y and the address electrode 9A during the sustain period, the lifetime of the phosphor is shortened. Here, in the IGBT-based half-bridge driving method according to the present invention, the amplitude of the driving voltage is double with respect to the conventional full-bridge driving method. Therefore, the voltage applied between the Y electrode 9Y and the address electrode 9A is also doubled. Therefore, a discharge between the Y electrode 9Y and the address electrode 9A disadvantageously tends to occur.

To prevent the above-described problems, the following scheme can be taken.

During a sustain period, it is assumed that the potential of the X electrode 9x is fixed at 0V and positive and negative voltages are alternately applied to the Y electrode. In this case, $|VXY|>|VtXY|$ and $|VAY|<|VtAY|$, where VXY is a voltage applied to a discharge space between the Y electrode 9Y and the X electrode 9X, VtXY is a firing voltage between the Y electrode 9Y and the X electrode 9X, VAY is a voltage applied to a discharge space between the Y electrode 9Y and the address electrode 9A, and VtAY is a firing voltage applied to between the Y electrode 9Y and the address electrode 9A.

With this, in a cell of the plasma display panel, a discharge occurs between the Y electrode 9Y and the X electrode 9X but not between the Y electrode 9Y and the address electrode 9A. Therefore, the life of the phosphor is not to be shorter than that in the conventional full-bridge driving method.

According to the present invention, the number of components of an AC-PDP can be reduced, and the number of assembling processes can be reduced. Also, a low-cost AC-PDP and semiconductor device realizing reduction of loss in a driving circuit and low power consumption can be achieved.

What is claimed is:

1. A plasma display device including a plasma display panel, the plasma display panel comprising:

a plurality of first electrodes;

a plurality of second electrodes disposed in approximately parallel with the plurality of first electrodes, the second electrodes forming display cells with the first electrodes adjacent to the second electrodes and discharge being executed between the first electrodes and the second electrodes forming the display cells; and a plurality of third electrodes formed in a crossing direction with respect to the first electrodes and the second electrodes, wherein during a period in which light emission of the plasma display panel is sustained, a potential of the first electrodes is maintained at a first constant potential, and a first positive voltage for the first electrodes and a second negative voltage for the first electrodes are alternately applied to the second electrodes, and a first driving circuit board for applying a voltage to the second electrodes comprises:

a first switch element clamped at a high level for carrying a gas-discharge current with light emission;

a second switch element clamped at a low level for carrying a gas-discharge current with light emission;

a third switch element for charging and discharging capacitance of the plasma display panel via a coil; and the first, the second, and the third switch elements being IGBTs.

2. The plasma display device according to claim 1, further comprising a chassis supporting the plasma display panel, wherein the first electrodes are electrically connected to the chassis, and the first potential is a potential of the chassis.

3. The plasma display device according to claim 1, wherein the first electrodes are connected to a power supply or a capacitor serving as the first potential.

4. The plasma display device according to claim 1, wherein the IGBTs used as the first, the second, the third switch elements are controlled for lifetime.

5. The plasma display device according to claim 1, wherein at least one of the first, the second, the third switch elements has a pair of main surfaces, and a first IGBT is used which comprises:

a first semiconductor layer having one conductive type and contacting with one of the main surfaces;

a second semiconductor layer having an other conductive type and contacting with the first semiconductor layer;

a third semiconductor layer having the other conductive type, contacting with the second semiconductor and having a lower imurity concentration than that of the second semiconductor layer;

a fourth semiconductor layer having the one conductive type, extending into the third semiconductor layer, having a higher impurity concentration than that of the third semiconductor layer, and contacting with the other of the main surfaces;

a fifth semiconductor layer having the one conductive type, extending into the fourth semiconductor layer, having a higher impurity concentration than that of the fourth semiconductor layer, and contacting with the other of the main surfaces;

a first main electrode existing on one of the main surfaces and contacting with the first semiconductor layer in a state of low resistance;

a second main electrode existing on the other of the main surfaces and contacting with the fourth and the fifth semiconductor layers in a state of low resistance; and a first insulating gate contacting with the third, the fourth, and the fifth semiconductor layers.

6. The plasma display device according to claim 5, wherein the first IGBT includes an insulating gate with a trench-gate structure.

7. The plasma display device according to claim 6, wherein the first IGBT has a sixth semiconductor layer having the one conductive type between trench gates, the sixth semiconductor layer being in a floating-state in potential or being connected to the second main electrode via a resistance.

8. The plasma display device according to claim 7, wherein a width of the fourth electrode having the one conductive type is 1.0 μm or smaller, the fourth electrode being formed between the trench gates of the first IGBT and being connected to the second main electrode in a state of low resistance.

9. The plasma display device according to claim 5, wherein a thickness of the second semiconductor layer in the first IGBT is 10 μm or smaller.

10. The plasma display device according to claim 1, wherein a first driving element as each of the first and the second switch elements is used, the first driving element comprising:

a pair of main surfaces;

the first IGBT capable of controlling, by gate, a first current flowing from a first main electrode on one of the main surfaces to a second electrode on the other; and a first diode integrated on the first IGBT and being capable of carrying a second current in a reverse direction to the first current.

11. The plasma display device according to claim 1, wherein a second driving element as the third switch element is used, the second driving element comprising:

a pair of main surfaces;

a second IGBT capable of controlling, by a gate, a third current flowing from a third main electrode on one of the main surfaces to a fourth electrode on the other; and a second diode integrated on the second IGBT and being capable of preventing a fourth current flowing in a reverse direction to the third current.

12. The plasma display device according to claim 11, wherein the second IGBT has a seventh semiconductor layer having the one conductive type between trench gates, the seventh semiconductor layer being in a floating-state in potential or being connected to the second main electrode via a resistance.

13. The plasma display device according to claim 12, wherein a width of a eighth electrode having the one conductive type is 1.0 μm or smaller, the eighth electrode being formed between the trench gates of the second IGBT and connected to the second main electrode in a state of low resistance.

14. The plasma display device according to claim 1, wherein a third IGBT having a pair of main surfaces as the third switch element is used, the first IGBT comprising:

a ninth semiconductor layer having one conductive type;

a tenth semiconductor layer having an other conductive type, contacting with a fifth main electrode in a state of low resistance, extending into the ninth semiconductor layer, and having a higher impurity concentration than that of the ninth semiconductor layer;

an eleventh semiconductor layer having the one conductive type, extending into the tenth semiconductor layer, contacting with the fifth main electrode in a state of low resistance, and having a higher impurity concentration than that of the tenth semiconductor layer;

a second insulating gate contacting with the ninth, the tenth, and the eleventh semiconductor layers;

a twelfth semiconductor layer having the other conductive type, contacting with a sixth main electrode in a state of low resistance, extending into the ninth semiconductor layer, and having a higher impurity concentration than that of the ninth semiconductor layer;

a thirteenth semiconductor layer having the one conductive type, extending into the twelfth semiconductor layer, contacting with the sixth main electrode in a state of low resistance, and having a higher impurity concentration than that of the twelfth semiconductor layer; and a third insulating gate contacting with the ninth, the twelfth, and the thirteenth semiconductor layers.

15. The plasma display device according to claim 14, wherein when the second insulating gate of the third IGBT is forward-biased to the fifth main electrode to be in an ON-state to cause a current to flow from the sixth main electrode to the fifth main electrode, the third insulating gate is inverse-biased or zero-biased to the sixth main electrode to be in an OFF-state.

16. The plasma display device according to claim 14, wherein when the second insulating gate of the third IGBT is inverse-biased or zero-biased to the fifth main electrode to be in an OFF-state to cause a current from the sixth main electrode to the fifth main electrode to be blocked, the third insulating gate is forward-biased to the sixth main electrode to be in an ON-state.

17. The plasma display device according to claim 14, wherein the third IGBT has a planar-gate structure in each of the insulating gates, the fifth main electrode and the sixth main electrode being formed on one of the main surfaces, and an a<b relation where a is a distance from an end of the tenth semiconductor layer on a sixth main electrode side to an end of the second insulating gate on a sixth main electrode side and b is a distance from the end of the tenth semiconductor layer on the sixth main electrode side to an end of the fifth main electrode on the sixth main electrode side.

18. The plasma display device according to claim 14, wherein the third IGBT has a trench gate structure in each of the insulating gates, the fifth main electrode and the sixth main electrode being formed on one of the main surfaces, and a region where the fifth main electrode contacts with the tenth semiconductor layer existing between the second insulating layer and the sixth main electrode.

19. The plasma display device according to claim 18, wherein the third IGBT has an a'<b' relation where a' is a distance from the second insulating gate and an end of the tenth semiconductor layer on the sixth main electrode side and b' is a distance from the second insulating gate to the end of the fifth main electrode on the sixth main electrode side.

20. The plasma display device according to claim 14, wherein the third IGBT has an a"<b" relation where a" is a distance from the second insulating gate to an end of the thirteenth semiconductor layer on the sixth main electrode side and b" is a distance from the second insulating gate to the end of the fifth main electrode on the sixth main electrode side.

21. The plasma display device according to claim 14, wherein the third IGBT comprises:

the fifth and the sixth main electrodes formed on the one of main surfaces;

a first insulating film covering the fifth and the sixth main electrodes;

a first and a second conductor plugs connected respectively to the fifth and the sixth main electrodes via an opening provided in the first insulating film; and a first and a second conductive layers connected respectively to the first and the second conductor plugs.

22. The plasma display device according to claim 14, wherein the third IGBT comprises:

the fifth main electrode and the sixth main electrode formed on the one of the main surfaces; and a seventh main electrode formed on the other, the seventh main electrode being insulated from the fifth and the sixth main electrodes.

23. The plasma display device according to claim 14, wherein the third IGBT comprises:

the fifth main electrode formed on the one of the main surfaces; and the sixth main electrode formed on the other.

24. The plasma display device according to claim 14, wherein the ninth semiconductor layer of the third IGBT makes a Schottky junction with at least one of the fifth and the sixth main electrodes.

25. The plasma display device according to claim 1, wherein the first driving circuit board comprises a module having the first, the second, and the third switch elements mounted on a surface of an insulating board, and the module includes a heat-dissipating plate on a surface opposite to a surface on which the first, the second, and the third switch elements are mounted.

26. The plasma display device according to claim 25, wherein the module includes a second driving element that drives gates of the first, the second, and the third switch elements.

27. The plasma display device according to claim 1, wherein when a voltage is applied to the second electrodes of the plasma display panel for light-emission of the panel, a voltage applied between the first electrode and the second electrode of the plasma display panel is larger than a firing voltage between the first electrode and the second electrode, and a voltage applied between the second electrode and the third electrode is smaller than a firing voltage between the second electrode and the third electrode.

28. A semiconductor device for driving a plasma display panel, comprising:

a plurality of first electrodes;

a plurality of second electrodes disposed in approximately parallel with the plurality of first electrodes, the second electrodes forming display cells with the first electrodes adjacent to the second electrodes and discharge being executed between the first electrodes and the second electrodes forming the display cells; and a plurality of third electrodes formed in a crossing direction with respect to the first electrodes and the second electrodes, wherein during a period in which light emission of the plasma display panel is sustained, a potential of the first electrodes is maintained at a first constant potential, and a first positive voltage for the first electrodes and a second negative voltage for the first electrodes are alternately applied to the second electrodes, and a first driving circuit board for applying a voltage to the second electrodes comprises:

a first switch element clamped at a high level for carrying a gas-discharge current with light emission;

a second switch element clamped at a low level for carrying a gas-discharge current with light emission;

a third switch element for charging and discharging capacitance of the plasma display panel via a coil; and the first, the second, and the third switch elements serving as IGBTs.

29. The semiconductor device for driving a plasma display panel according to claim 28, wherein at least one of the first, the second, the third switch elements has a pair of main surfaces, a first IGBT is used which comprises:

a first semiconductor layer having one conductive type and contacting with one of the main surfaces;

a second semiconductor layer having an other conductive type and contacting with the first semiconductor layer;

a third semiconductor layer having the other conductive type, contacting with the second semiconductor and having a lower impurity concentration than that of the second semiconductor layer;

a fourth semiconductor layer having the one conductive type, extending into the third semiconductor layer, having a higher impurity concentration than that of the third semiconductor layer, and contacting with the other of the main surfaces;

a fifth semiconductor layer having the one conductive type, extending into the fourth semiconductor layer, having a higher impurity concentration than that of the fourth semiconductor layer, and contacting with the other of the main surfaces;

a first main electrode existing on one of the main surfaces and contacting with the first semiconductor layer in a state of low resistance;

a second main electrode existing on the other and contacting with the fourth and the fifth semiconductor layers in a state of low resistance; and a first insulating gate contacting with the third, the fourth, and the fifth semiconductor layers.

* * * * *